US010407999B2

(12) United States Patent
Pratt et al.

(10) Patent No.: US 10,407,999 B2
(45) Date of Patent: Sep. 10, 2019

(54) VIBRATION DAMPENER

(71) Applicant: EXTENSIVE ENERGY TECHNOLOGIES PARTNERSHIP, Calgary, Alberta (CA)

(72) Inventors: F. Dale Pratt, Calgary (CA); Kenneth A. Lambe, Calgary (CA); Doru Gorzo, Calgary (CA)

(73) Assignee: EXTENSIVE ENERGY TECHNOLOGIES PARTNERSHIP, Calgary, Alberta (CA)

( * ) Notice: Subject to any disclaimer, the term of this patent is extended or adjusted under 35 U.S.C. 154(b) by 0 days.

(21) Appl. No.: 15/590,773

(22) Filed: May 9, 2017

(65) Prior Publication Data

US 2017/0328142 A1 Nov. 16, 2017

Related U.S. Application Data

(60) Provisional application No. 62/334,863, filed on May 11, 2016.

(51) Int. Cl.
*E21B 17/07* (2006.01)
*E21B 47/01* (2012.01)
(Continued)

(52) U.S. Cl.
CPC ..... *E21B 17/07* (2013.01); *E21B 47/011* (2013.01); *E21B 47/18* (2013.01); *E21B 17/073* (2013.01);
(Continued)

(58) Field of Classification Search
CPC ..... E21B 17/07; E21B 17/073; E21B 17/10; E21B 47/00; E21B 47/011; E21B 21/08
See application file for complete search history.

(56) References Cited

U.S. PATENT DOCUMENTS 3,306,078 A 2/1967 Hughes
3,406,537 A 10/1968 Falkner, Jr.
(Continued)

FOREIGN PATENT DOCUMENTS

WO 2013/050231 A2 4/2013

*Primary Examiner* — David J Bagnell
*Assistant Examiner* — Yanick A Akaragwe
(74) *Attorney, Agent, or Firm* — Heslin Rothenberg Farley & Mesiti P.C.; Victor A. Cardona, Esq.

(57) ABSTRACT

A dampener device is configured for incorporation into a downhole measurement tool in a drilling system, for absorbing axial, lateral and torsional shocks and vibrations to protect measurement instrumentation located above the device during drilling. The device includes: a main sleeve having a main cavity containing a main spring; an adapter connected to or formed monolithically relative to the main sleeve, the adapter configured for connection to a first tool component; a plunger configured to compress the main spring; a connector configured for connection to a second tool component, the connector attached to or formed monolithically relative to the plunger; a shaft extending between the adapter and the connector, the shaft provided with an anti-rotation structure; and one or more passages leading from the outside of the device into the main cavity. The passages are provided to allow drilling fluid to enter the main cavity to act as vibration dampening fluid.

20 Claims, 21 Drawing Sheets

(51) Int. Cl.

| | |
|---|---|
| ***E21B 17/10*** | (2006.01) |
| ***E21B 47/18*** | (2012.01) |
| *E21B 21/08* | (2006.01) |
| *E21B 47/00* | (2012.01) |

(52) U.S. Cl.
CPC ..... *E21B 17/10* (2013.01); *E21B 21/08* (2013.01); *E21B 47/00* (2013.01)

(56) References Cited

U.S. PATENT DOCUMENTS

| | | | | |
|---|---|---|---|---|
| 5,083,623 | A | 1/1992 | Barrington | |
| 5,964,307 | A | 10/1999 | Wenzel | |
| 6,808,455 | B1 | 10/2004 | Solorenki et al. | |
| 8,640,795 | B2 | 2/2014 | Jekielek | |
| 9,109,410 | B2 | 8/2015 | Swietlik et al. | |
| 9,435,162 | B2 * | 9/2016 | Duhe | E21B 21/08 |
| 2009/0023502 | A1 | 1/2009 | Koger | |
| 2009/0107680 | A1 * | 4/2009 | Surjaatmadja | E21B 17/07 166/308.1 |
| 2011/0120772 | A1 | 5/2011 | McLoughlin et al. | |
| 2011/0198126 | A1 | 8/2011 | Swietlik et al. | |
| 2012/0152518 | A1 | 6/2012 | Johanning et al. | |
| 2012/0228028 | A1 | 9/2012 | Turner et al. | |
| 2012/0247832 | A1 | 10/2012 | Cramer et al. | |
| 2015/0259989 | A1 | 9/2015 | Gajji et al. | |
| 2015/0376959 | A1 | 12/2015 | Dinica et al. | |
| 2016/0002985 | A1 | 1/2016 | Baudoin | |

* cited by examiner

SECTION B-B

SECTION C-C

SECTION D-D

VIBRATION DAMPENER

CROSS-REFERENCE TO RELATED APPLICATIONS

This application claims priority from U.S. Provisional Application Ser. No. 62/334,863 filed on May 11, 2016, the entire disclosure of which is incorporated herein by reference.

FIELD OF THE INVENTION

The invention relates generally to the field of down-hole sensor equipment and more specifically to a device for dampening vibrations which interfere with down-hole sensors.

BACKGROUND OF THE INVENTION

The desirability and effectiveness of well logging systems (also known as measurement-while drilling systems) where information is sensed in the well hole and transmitted to the surface. In one example, mud pulse telemetry systems provide the operator at the surface with means for quickly determining various kinds of downhole information, most particularly information about the location, orientation and direction of the drill string at the bottom of the well in a directional drilling operation. During normal drilling operations, a continuous column of mud is circulating within the drill string from the surface of the well to the drilling bit at the bottom of the well and then back to the surface.

Mud pulse telemetry repeatedly restricts the flow of mud to generate a pressure increase measured at surface directly proportional to the flow restriction downhole to propagate pressure signals encoding data generated by downhole sensors through the mud upward to the surface.

Electromagnetic telemetry uses current injection to send encoded data generated by downhole sensors to surface as an alternative method of telemetering downhole data.

A telemetry system may be lowered on a wireline located within the drill string, but is usually formed as an integral part of a special drill collar inserted into the drill string near the drilling bit. The basic operational concept of mud pulse telemetry is to intermittently restrict the flow of mud as it passes through a downhole telemetry valve, thereby creating a pressure pulse in the mud stream that travels to the surface of the well.

In mud pulse telemetry, the information sensed by instrumentation in the vicinity of the drilling bit is encoded into a digital formatted signal and is transmitted by instructions to pulse the mud by intermittently actuating the telemetry valve, which restricts the mud flow in the drill string, thereby transmitting pulses to the well surface where the pulses are detected and transformed into electrical signals which can be decoded and processed to reveal transmitted information.

In a similar matter, electromagnetic telemetry injects a current across an electrically isolated gap in the drill collar to react an electromagnetic impulse proportional to the encoded data which is detected a surface by sensitive voltage detection methods using conductive electrode stakes inserted into the earth and/or the casing of the well being drilled to provide electrodes. This encoded data is decoded and processed in similar manner as mud pulse transmitted data.

One problem encountered in all measurement-while-drilling systems and logging-while-drilling systems is that the drilling process involves axial and radial vibrations and shocks which can interfere with smooth transmission of signals generated by the sensors. Devices known as dampeners have been developed in efforts to address these problems. Dampeners and related peripheral technologies have been described in US Patent Publication Nos. U.S.20160002985, U.S.20150376959, U.S.20150259989, U.S.20120247832, U.S.20120228028, U.S.20120152518, U.S.20120247832 U.S.20110120772, U.S.20110198126 and U.S.20090023502, U.S. Pat. Nos. 9,109,410, 8,640,795, 6,808,455, 5,964,307, 5,083,623, 3,406,537 and 3,306,078 and International Patent Application No. WO2013050231, each of which is incorporated herein by reference in its entirety.

A need exists for improvements over known shock/vibration dampener devices which provide enhanced capabilities and simplified structures to provide manufacturing advantages and ease of maintenance.

SUMMARY OF THE INVENTION

One aspect of the invention is a dampener device configured for incorporation into a downhole tool in a drilling system, the device for absorbing axial, lateral and torsional shocks and vibrations to protect instrumentation during drilling, the device comprising: a main sleeve having a main cavity containing a main spring; an adapter connected to or formed monolithically relative to the main sleeve, the adapter configured for connection to a first tool component; a plunger configured to compress the main spring; a connector configured for connection to a second tool component, the connector attached to or formed monolithically relative to the plunger; a shaft extending between the adapter and the connector, the shaft provided with an anti-rotation structure; and one or more passages leading from the outside of the device into the main cavity, the passages provided to allow drilling fluid to enter the main cavity to act as vibration dampening fluid.

In certain embodiments, the shaft and the plunger are the same structure, the connector is formed monolithically relative to the shaft and the main spring is connected to the shaft.

In certain embodiments, the device further comprises a secondary spring in a secondary cavity of the sleeve which is spaced apart from the main cavity.

In certain embodiments, the device further comprises a first elastomeric ribbon interleaved between coils of the main spring and a second elastomeric ribbon interleaved between the coils of the secondary spring.

In certain embodiments, the sleeve includes a sleeve extension and the secondary cavity is defined by the interior of the sleeve extension.

In certain embodiments, the device further comprises one or more additional passages leading from the outside of the device into the secondary cavity to act as secondary cavity vibration dampening fluid.

In certain embodiments, the second tool component includes a main pulser unit of a measurement-while-drilling tool assembly and the first tool component includes a pulse actuator of the measurement-while drilling tool assembly.

In certain embodiments, the shaft includes a drilling fluid channel extending across its entire length, the drilling fluid channel provided to transmit drilling fluid pulses from a pulse actuator to a main pulser unit when used with a mud pulse telemetry system or to provide a path for routing of electrical connections when used with an electromagnetic telemetry system.

In certain embodiments, the anti-rotation structure is portion of the shaft having a polygonal cross section which resides within a complementary cavity with polygonal cross section.

In certain embodiments, the main spring is slidable within the main cavity.

In certain embodiments, the plunger is a second sleeve configured for telescopic movement into and out of the cavity of the main sleeve.

In certain embodiments, the one or more passages are partially restricted by the presence of wiper seals which allow entry of the drilling fluid into one or both of the main cavity and the secondary cavity while acting as a barrier to exclude entry of particulate matter carried by the drilling fluid.

In certain embodiments, one of the wiper seals is located between the shaft and an inner sidewall of the main sleeve or located between the shaft and an inner sidewall of the sleeve extension.

In certain embodiments, one of the wiper seals is located between a ring-shaped shaft-retaining member at the end of the shaft and the end opening of the cavity of the second sleeve.

In certain embodiments, one of the wiper seals is located between the inner sidewall of the second sleeve and the outer sidewall of the shaft at a position closer to the inner end of the second sleeve than to the outer end of the second sleeve.

In certain embodiments, the device further comprises a collar located inside the cavity of the first sleeve for connecting the inner end of the spring to the inner end of the second sleeve, wherein the shaft extends through a central channel in the collar.

In certain embodiments, one of the wiper seals is located between the outer sidewall of the collar and the inner sidewall of the first sleeve.

In certain embodiments, the wiper seals include: a first wiper seal located between a ring-shaped retaining member at the end of the shaft and the end opening of the cavity of the second sleeve; a second wiper seal located between the inner sidewall of the second sleeve and the outer sidewall of the shaft at a position closer to the inner end of the second sleeve than to the outer end of the second sleeve; and a third wiper seal located between the outer sidewall of the collar and the inner sidewall of the first sleeve.

In certain embodiments, the one or more passages is a single passage located in a reduced diameter portion inside the second sleeve to allow the drilling fluid to move from the outer end of the second sleeve to the cavity of the second sleeve.

In certain embodiments, an outer hollow adapter is connected to the outer end of the first sleeve and the shaft extends through the hollow adapter and is immobilized thereto by a retaining nut.

In certain embodiments, the cavity of the second sleeve holds one or more secondary springs around the circumference of the shaft for providing additional compression dampening.

In certain embodiments, the device further comprises a first elastomeric ribbon interleaved between coils of the main spring and a second elastomeric ribbon interleaved between the coils of the one or more secondary springs.

In certain embodiments, the one or more secondary springs comprises a set of three secondary springs with two intervening ring-shaped baffles around the circumference of the shaft for restricting flow of drilling fluid in the cavity of the second sleeve.

In certain embodiments, the second tool component includes a main pulser unit of a measurement-while-drilling tool assembly and the first tool component includes a pulse actuator of the measurement-while drilling tool assembly.

In certain embodiments, the second tool component includes a main pulser unit of a measurement-while-drilling tool assembly and the first tool component includes a pulse actuator of the measurement-while drilling tool assembly.

In certain embodiments, the shaft includes a drilling fluid channel extending across its entire length, the drilling fluid channel provided to transmit drilling fluid pulses from a pulse actuator to a main pulser unit when used with a mud pulse telemetry system or to provide a path for routing of electrical connections when used with an electromagnetic telemetry system.

In certain embodiments, the anti-rotation sleeve-coupling structure of the shaft comprises a series of splines arranged around the circumference of a portion of the shaft.

In certain embodiments, the anti-rotation shaft-coupling structure of the second sleeve comprises a series of grooves arranged around the circumference of the inner sidewall of the second sleeve, the grooves dimensioned to retain the splines while allowing the second sleeve to slide over the shaft.

In certain embodiments, the shaft is formed of a titanium alloy.

In certain embodiments, the titanium alloy has a modulus of elasticity between about 102.4 GPa to about 125.2 GPa.

In certain embodiments, the titanium alloy is Titanium Ti-6Al-4V.

Another aspect of the invention is a dampener device configured for incorporation into a downhole tool in a drilling system, the device for absorbing axial, lateral and torsional shocks and vibrations to protect instrumentation during drilling, the device comprising: a first sleeve having a cavity containing a main spring; a second sleeve configured for telescopic movement into and out of the cavity of the first sleeve, the second sleeve having a cavity defined by an inner sidewall having an anti-rotation shaft-coupling structure; and a shaft having an anti-rotation sleeve-coupling structure complementary to the anti-rotation shaft-coupling structure, the shaft extending across a majority portion of the length of the cavity of the first sleeve and the cavity of the second sleeve, the shaft immobilized at the outer end of the first sleeve and retained by the second sleeve while permitting axial movement of the second sleeve along the shaft during the telescopic movement of the second sleeve into and out of the first sleeve; and wherein the device includes one or more passages leading from the outside of the device into the cavity of the first sleeve or the cavity of the second sleeve, the passages provided to allow drilling fluid to enter the cavity of the first sleeve and/or the cavity of the second sleeve to act as vibration dampening fluid.

In certain embodiments, the one or more passages are partially restricted by the presence of wiper seals which allow entry of the drilling fluid into one or both of the cavity of the first sleeve and the cavity of the second sleeve while acting as a barrier to exclude entry of particulate matter carried by the drilling fluid.

In certain embodiments, one of the wiper seals is located between the shaft and an inner sidewall of the first sleeve or located between the shaft and an inner sidewall of the second sleeve.

In certain embodiments, one of the wiper seals is located between a ring-shaped shaft-retaining member at the end of the shaft and the end opening of the cavity of the second sleeve.

In certain embodiments, one of the wiper seals is located between the inner sidewall of the second sleeve and the outer sidewall of the shaft at a position closer to the inner end of the second sleeve than to the outer end of the second sleeve.

In certain embodiments, the device further comprises a collar located inside the cavity of the first sleeve for connecting the inner end of the spring to the inner end of the second sleeve, wherein the shaft extends through a central channel in the collar.

In certain embodiments, wherein one of the wiper seals is located between the outer sidewall of the collar and the inner sidewall of the first sleeve.

In certain embodiments, the wiper seals include: a first wiper seal located between a ring-shaped retaining member at the end of the shaft and the end opening of the cavity of the second sleeve; a second wiper seal located between the inner sidewall of the second sleeve and the outer sidewall of the shaft at a position closer to the inner end of the second sleeve than to the outer end of the second sleeve; and a third wiper seal located between the outer sidewall of the collar and the inner sidewall of the first sleeve.

In certain embodiments, the one or more passages is a single passage located in a reduced diameter portion inside the second sleeve to allow the drilling fluid to move from the outer end of the second sleeve to the cavity of the second sleeve.

In certain embodiments, an outer hollow adapter is connected to the outer end of the first sleeve and the shaft extends through the hollow adapter and is immobilized thereto by a retaining nut.

In certain embodiments, the cavity of the second sleeve holds one or more secondary springs around the circumference of the shaft for providing additional compression dampening.

In certain embodiments, the device further comprises a first elastomeric ribbon interleaved between coils of the main spring and a second elastomeric ribbon interleaved between the coils of the one or more secondary springs.

In certain embodiments, the one or more secondary springs comprises a set of three secondary springs with two intervening ring-shaped baffles around the circumference of the shaft for restricting flow of drilling fluid in the cavity of the second sleeve.

In certain embodiments, the outer end of the second sleeve is configured for connection to a second tool component and the outer end of the adapter is configured for connection to a first tool component.

In certain embodiments, the second tool component includes a main pulser unit of a measurement-while-drilling tool assembly and the first tool component includes a pulse actuator of the measurement-while drilling tool assembly.

In certain embodiments, the shaft includes a drilling fluid channel extending across its entire length, the drilling fluid channel provided to transmit drilling fluid pulses from the pulse actuator to the main pulser unit. In certain embodiments, the second tool component includes a main pulser unit of a measurement-while-drilling tool assembly and the first tool component includes a pulse actuator of the measurement-while drilling tool assembly.

In certain embodiments, the shaft includes a drilling fluid channel extending across its entire length, the drilling fluid channel provided to transmit drilling fluid pulses from a pulse actuator to a main pulser unit when used with a mud pulse telemetry system or to provide a path for routing of electrical connections when used with an electromagnetic telemetry system.

In certain embodiments, the anti-rotation sleeve-coupling structure of the shaft comprises a series of splines arranged around the circumference of a portion of the shaft.

In certain embodiments, the anti-rotation shaft-coupling structure of the second sleeve comprises a series of grooves arranged around the circumference of the inner sidewall of the second sleeve, the grooves dimensioned to retain the splines while allowing the second sleeve to slide over the shaft.

In certain embodiments, the shaft includes a circumferential groove for holding an inner retaining ring with an outer concave sidewall and the second wiper seal is located in the concave sidewall.

In certain embodiments, the adapter has an inner sidewall with an anti-rotation shaft coupling structure which is complementary to an anti-rotation adapter coupling structure.

In certain embodiments, the inner sidewall of the adapter defines a square- or rectangular-shaped cavity portion acting as the anti-rotation shaft coupling structure and the shaft has a square- or rectangular portion acting as the anti-rotation adapter-coupling structure.

In certain embodiments, the main spring in the first sleeve is captured with respect to the outer end of the first sleeve and the inner end of the second sleeve.

In certain embodiments, the shaft is formed of a titanium alloy.

In certain embodiments, the titanium alloy has a modulus of elasticity between about 102.4 GPa to about 125.2 GPa.

In certain embodiments, the titanium alloy is Titanium Ti-6Al-4V.

In certain embodiments, the dampener device further comprises a cable or wire extending through the channel, the cable or wire configured for connection to components of an electromagnetic telemetry system.

In certain embodiments, the dampener device includes a retention spring located between first and second blocking structures located within the second sleeve.

In certain embodiments the first blocking structure is the collar and the second blocking structure is the split-shell retainer.

Another aspect of the invention is a measurement-while-drilling tool assembly comprising: an instrumentation module for holding sensors used in generating measurement data; a pulse actuator for generating signal pulses encoding the measurement data, the pulse actuator connected to a down-hole end of the instrumentation module; a dampener device as described herein, connected to a down-hole end of the pulse actuator; and a pulser unit for generating pulses actuated by the pulse actuator for propagation up the drill string and decoding at the surface; the pulser unit connected to a down-hole end of the dampener device.

Another aspect of the invention is a use of the dampener device as described herein in a downhole assembly configured to obtain measurements for mud-pulse telemetry, logging-while drilling, electromagnetic surveying, electromagnetic telemetry or gyroscopic surveying.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Rationale

Figure 1:
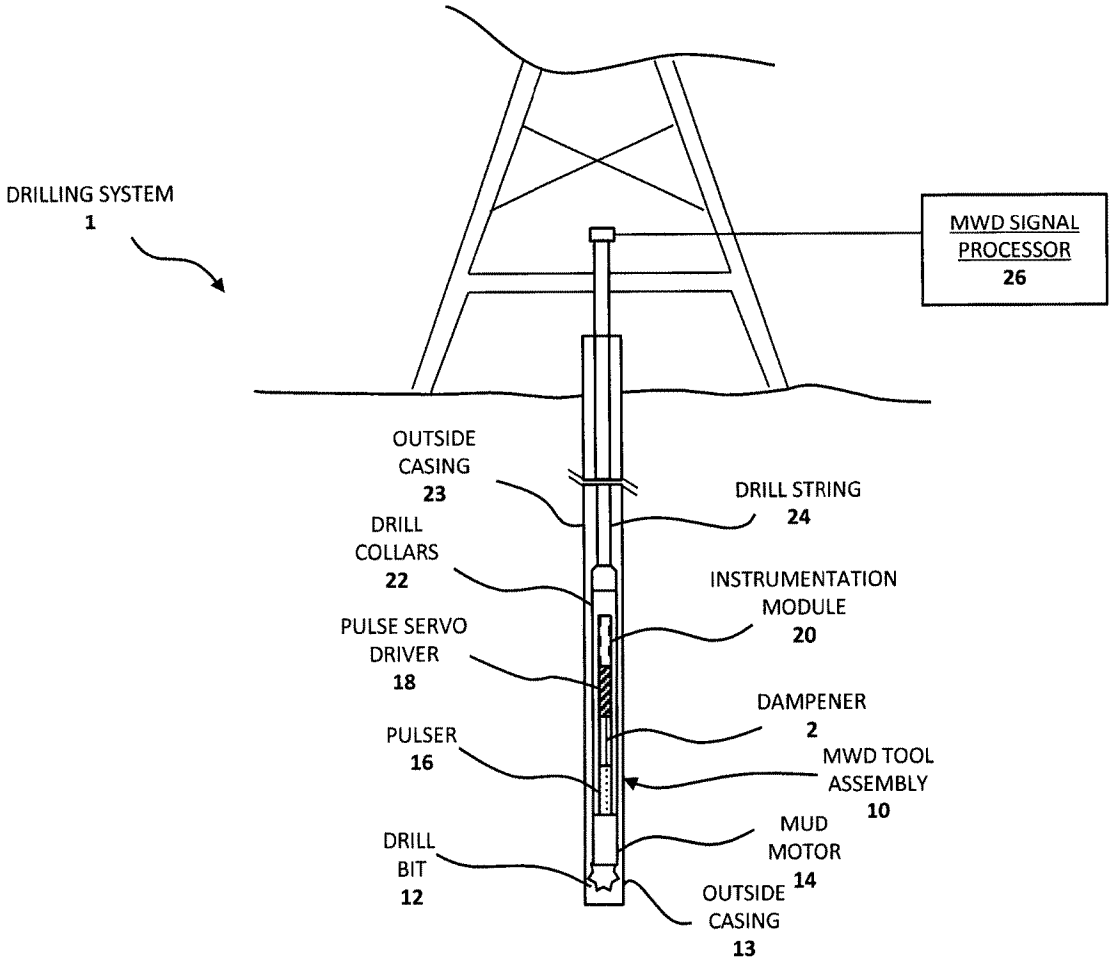
FIG. 1 is a schematic representation of a drilling system 1 showing a downhole measurement-while-drilling tool assembly 10 which includes a pulser 16, a dampener 2 according to embodiments described herein, a pulse driver or electromagnetic dipole transmitter 18 and measurement-while-drilling instrumentation 20.

The present invention provides a significantly improved dampener device to protect downhole instrumentation (which may include instrumentation for measurement-while-drilling, logging-while drilling, electromagnetic surveying, or gyro-surveying) and other mechanical equipment associated therewith) from damage caused by vibrations and shocks which occur during drilling as a result of percussion of the drill bit and mud motor in combination with rotation of the drill collar and sudden stop and start conditions. The instrumentation is contained within one or more tools associated with a drill collar and typically seated in a structure known as an "orienting sub" or a "mule shoe," which is typically located approximately 10 meters above the drill bit. This close proximity to the drill bit means that the shocks and vibrations are easily transmitted to the instrumentation. This problem has been exacerbated by development of new percussion drilling technologies which use hammering drill bits that increase the impacts and vibrations during drilling.

This configuration is reversed for hanging systems where the tool is suspended from an oriented sub and the bulk of the tool is hanging when vertical, the dampener would be placed between the pulser and the tool modules. For example, in a hanging electromagnetic telemetry system, the shock dampener would be located between the orienting sub and the entire hanging measurement-while-drilling string.

Previous attempts to address these problems have led to development of dampener devices that have rubber shock absorbing components and/or closed internal cavities containing dampening fluids which often leak from enclosed bladders and reduce the shock absorbing capability of the dampening device. Most of these dampening devices do not have the capability to dampen rotational shocks and to dampen low frequency vibrations. Additionally, the compression springs employed in known dampening devices are subject to premature wear and failure.

The present inventors have recognized that a dampener device can be greatly improved by addressing at least some of these unsatisfactory aspects. In certain embodiments, the device has a main spring captured between the outer end of the main sleeve and the inner end of the plunger sleeve which telescopes into the main sleeve. In other embodiments, the plunger function is provided by an anti-rotation shaft connected to a main spring.

In other embodiments, an improved spring and baffle combination is provided to absorb axial vibrations.

In other embodiments, the anti-rotation shaft is provided with sufficient elasticity to allow it to act as a torsion bar to absorb rotational shocks.

In other embodiments, one or more passages for drilling fluid into the cavities of the device are provided, some of which are provided with wiper seals to prevent entry of particulate matter carried by the drilling fluid. The drilling fluid enhances the dampening effect and overcomes the problem of loss of dampening capability via loss of enclosed hydraulic dampening fluid in known dampening devices. As such, these embodiments of the dampening device have a significantly strengthened dampening effect and are cost-effective to manufacture and maintain because there is no need to conduct purging as required for dampeners that use hydraulic fluid.

Definitions

As used herein, the term "measurement-while-drilling" refers to measurement and immediate transmission of data to the surface. Data is obtained from sensors and instrumentation associated with well drilling equipment in a bottom hole assembly tool and transmission of the data is performed using a transmission technique such as mud pulse telemetry or electromagnetic telemetry for example. The data generated during measurement-while-drilling typically relates to directional-drilling measurements, such as the location of the drill bit, and the rate of penetration for example.

As used herein, the term "mud pulse telemetry" refers to a process which uses valves to modulate the flow of drilling fluid in the bore of the drill string, generating pressure pulses that transmit information to the surface as a result of the non-compressible fluid acting on the entire fluid column essentially instantaneously.

As used herein, the term "logging while drilling" refers to collection and storage of data in a module of a bottom hole assembly, which is not transmitted immediately to the surface (as in measurement while drilling) but instead is downloaded after retrieval of the bottom hole assembly from the well bore. The data generated during logging-while drilling usually pertains to features of the geological formation being penetrated in the drilling process.

As used herein, the term "electromagnetic telemetry" refers to a current injection method for propagating magnetic impulses to the surface across an electrically insulated gap. The technique uses a downhole current generation across an electrically isolated gap to create a positive and negative dipole system to induce an electromagnetic field in the formation. The electromagnetic response is measured using electrodes inserted in the surface earth measuring a potential change across the two electrodes as magnetic waves travel to surface. The magnetic impulse readings encode data which is decoded in a manner similar to the decoding in mud pulse telemetry.

As used herein, the term "gyroscopic survey" refers to surveys which use gyroscope equipment to measure the change in orientation of the downhole tool as it follows the well path, relative to the original spin axis orientation at the start of the survey.

As used herein, the term "actuator" refers to a system which supplies or transfers energy for operation of a device.

As used herein, the term "servo" is used as an adjective to indicate a component acting as a part of a servomechanism. A "servomechanism" is an electronic control system in which a main controlling mechanism is actuated by a secondary system which uses less energy.

As used herein, the term "torsion bar" refers to a bar or shaft forming part of the dampener device, which does not rotate but instead twists in response to torsional forces and returns to its original shape due to its elasticity.

As used herein, the terms "mud," "drilling mud" or "drilling fluid" are synonymous and refer to water-based or oil-based suspensions of clays and other chemical components which are pumped into an oil well during drilling in order to seal off porous rock layers, equalize the pressure, cool the drill bit, and flush out the cuttings.

As used herein, the term "wiper seal" refers to a ring-shaped axial seal that provides general fluid containment between the seal and a reciprocating member which moves past the seal while preventing particulate matter from entering the seal's inner bore.

As used herein, the term "complementary" is used to indicate parts shaped to fit together to generate a particular function, for example to immobilize an aspect of movement of one part with respect to a second part.

As used herein, the term "spline" refers to a series of projections on a component that fit into slots or grooves on another component.

As used herein, the term "anti-rotation" is used to refer to a characteristic of one component and/or one or more additional components associated therewith which prevents the component from rotating with respect to the additional components.

As used herein, the term "coil spring" refers to a helical spring formed of wire or a metal band which is used to store and subsequently release energy in absorbing shocks and vibrations.

As used herein, the term "captured spring" or "captured coil spring" refers to a coil spring attached to another component at each end.

Introduction

Various aspects of the invention will now be described with reference to the figures. For the purposes of illustration, components depicted in the figures are not necessarily drawn to scale in all cases. Instead, emphasis is placed on highlighting the contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Measurement-While-Drilling System Overview

Referring now to FIG. 1, there is shown a schematic representation of a drilling system 1 showing the context of a generalized dampener device 2 of the invention. It is seen that the generalized dampener 2 in this context is incorporated into a measurement-while-drilling downhole tool assembly 10 located in an arrangement of drill collars 22 within a casing 13 above the mud motor 14 and drill bit 12. Such a downhole measurement-while-drilling tool 10 may be arranged conventionally with respect to a mule shoe and universal bottom hole sub as known in the art (not shown). Additionally, while shown here as incorporated into a measurement-while-drilling tool, the dampener 2 and various alternative embodiments thereof may be incorporated into a different tool such as a specialized logging-while-drilling tool at an appropriate connection point identified by the skilled person. Or reversed as is the case in a hanging measurement-while-drilling tool with the universal bore hole orienting (UBHO) sub located above the tool. The dampener 2 operates in a manner similar to an automobile suspension with a spring and shock absorber arrangement to absorb the energy of the moving mass and dampen oscillations.

It is seen in FIG. 1 that the dampener 2 is disposed between the mud pulser 16 and the pulse servo driver 18. The pulse servo driver 18 is directly below the instrumentation module 20 which is responsible for generating measurement-while-drilling data for transmission to the surface by mud pulse telemetry. The data generated by the instrumentation 20 is encoded as a wired data transmission to a servo actuator which converts the measurement-while-drilling data to actuator signals. These signals open and close a poppet valve (not shown) in the pulse servo driver 18 which functions in a servomechanism. The opening and closing transmits drilling mud to a main valve in the pulser 16 located below the dampener 2 which generates the pulses that are then transmitted up through the drill string 24 to a signal processor 26 at the surface. The signal processor 26 then decodes the pulses to generate useful measurement-while-drilling data. The actuator signals generated at the pulse servo driver 18 pass through a mud channel in the dampener 2 to the pulser 16 as described below. In the case of an electromagnetic telemetry system, electrical wiring or fiber optics are passed through the center of the inner shaft to interconnect modules. In the case of a hanging mud pulser system the pulser may be situated above the dampener.

In general terms, the dampener 2 is provided to absorb axial, lateral and torsional shocks generated during operation of the drill bit 12 and the mud motor 14 thereby preventing such shocks from being transmitted to the sensitive pulse servo driver 18 and the instrumentation module 20 located above the pulser 16. The structural features and the operation of two different embodiments of the dampener will be described in more detail hereinbelow.

Structural Features of a First Embodiment of the Dampener

Figure 2A:
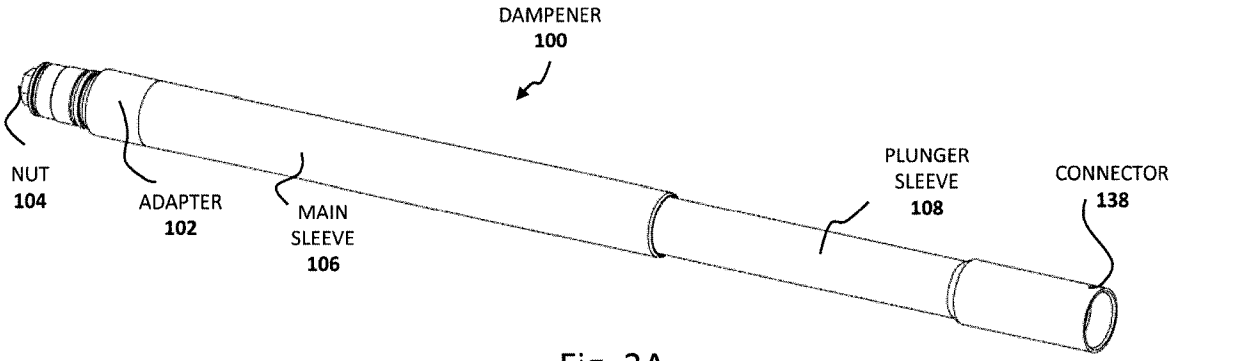
FIG. 2A is a perspective view of a dampener device 100 of one embodiment of the invention.
Figure 2B:
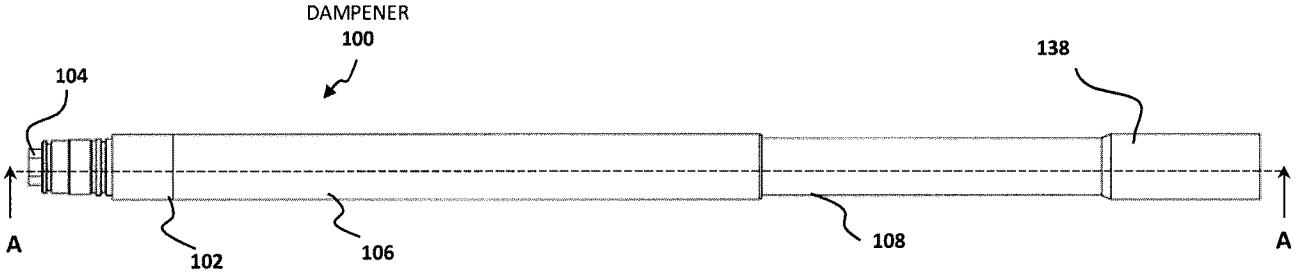
FIG. 2B is a plan view of the same embodiment of the dampener device 100.
Figure 2C:
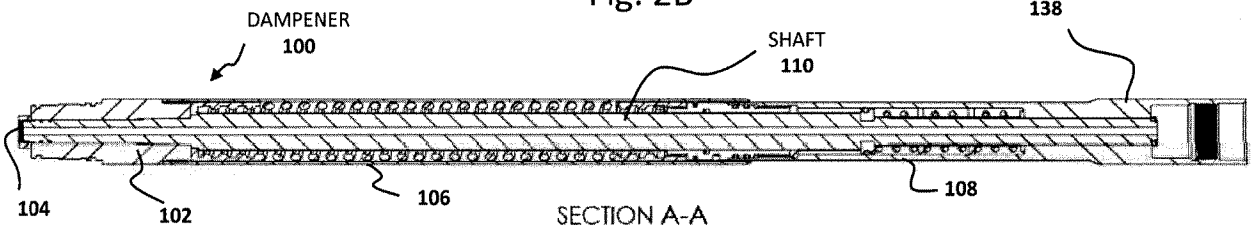
FIG. 2C is a cross sectional view of taken along line A-A of FIG. 2B.

Turning now to FIGS. 2A to 2C, there is shown a series of views of a dampener 100 according to a first embodiment of the invention. The components of this embodiment of the dampener 100 are identified using reference numerals in the 100 series. FIG. 2A shows the dampener 100 in a perspective view. The components visible on the outside of the dampener 100 include the adapter 102 which is configured, in this particular embodiment for connection to a pulser actuator unit as in described in U.S. patent application Ser. No. 15/375,407, which is incorporated herein by reference in its entirety. Alternative embodiments have alternative adapter features for connection to alternative pulser actuators which are configurable by the skilled person without undue experimentation.

A retaining nut 104 is visible on the left end of the adapter 102 in the orientation shown. The nut 104 threads onto a shaft 110 retained inside the dampener 100 (the shaft is not visible in FIGS. 2A and 2B, but is seen in the cross sectional view in FIG. 2C). The right side of the adapter 102 is connected to a main sleeve 106 by a threading connection in this particular embodiment and it is seen that a plunger sleeve 108 to the left of the main sleeve 106 has a majority portion with a smaller diameter than that of the main sleeve 106 such that a portion of the plunger sleeve 108 telescopes inside the main sleeve 106 during operation of the device in a drilling system. The right end of the plunger sleeve 108 terminates in a threaded connector 138 for connection to a main pulser unit.

FIG. 2B is a side elevation view of the same embodiment of the dampener 100 and FIG. 2C is a cross sectional view of the dampener 100 taken along line A-A of FIG. 2B which reveals interior components of the dampener. These interior components are seen in more detail in FIGS. 3A to 3C which show three separate magnified cross-sectional segments of the interior of the dampener 100. For greater clarity of the arrangement of components, all of the components shown in FIGS. 3A to 3C are also seen in the exploded views of FIG. 4A (perspective) and FIG. 4B (side elevation).

Figure 3A:
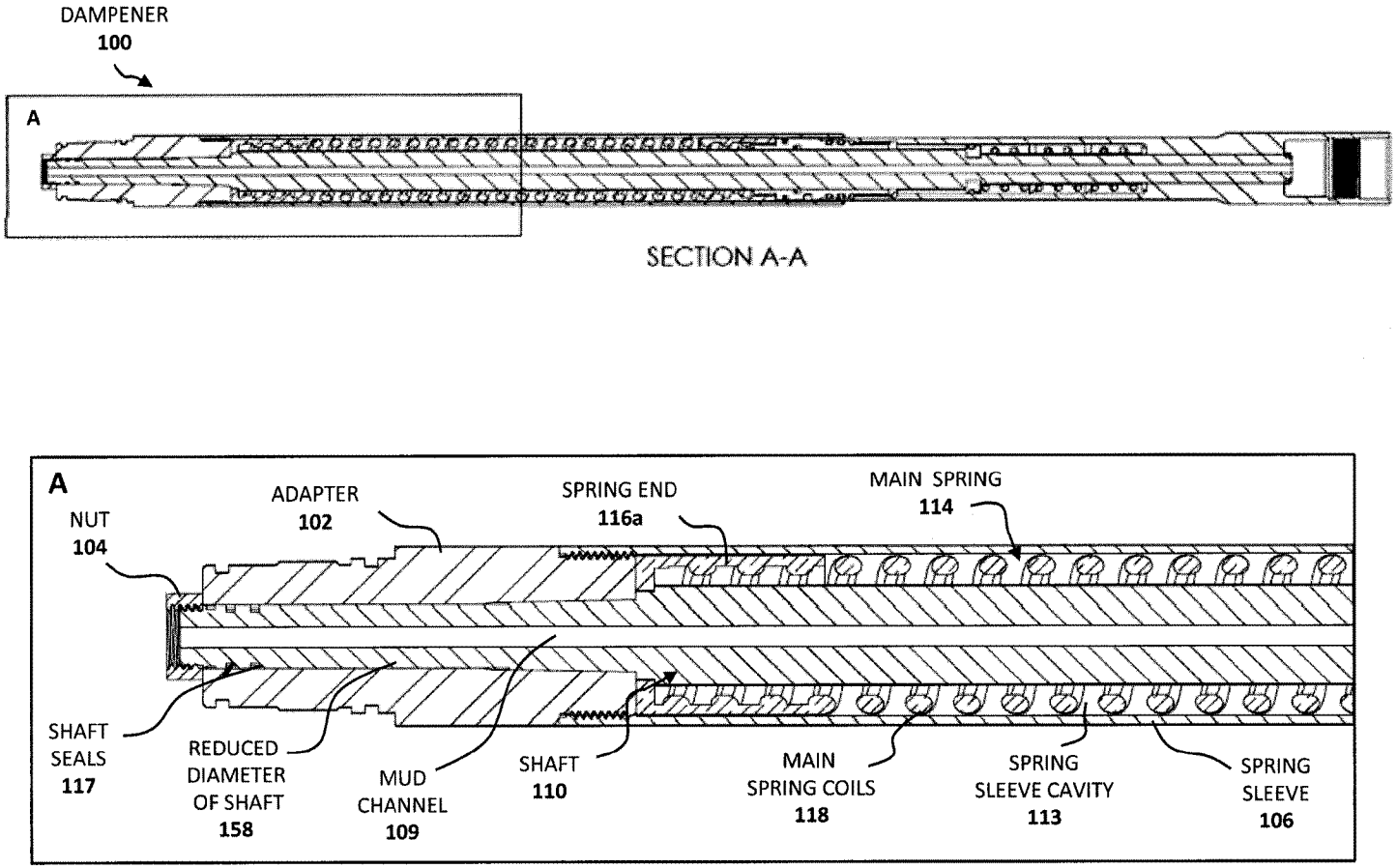
FIG. 3A is the same view of FIG. 2C with a magnified portion A.
Figure 3B:
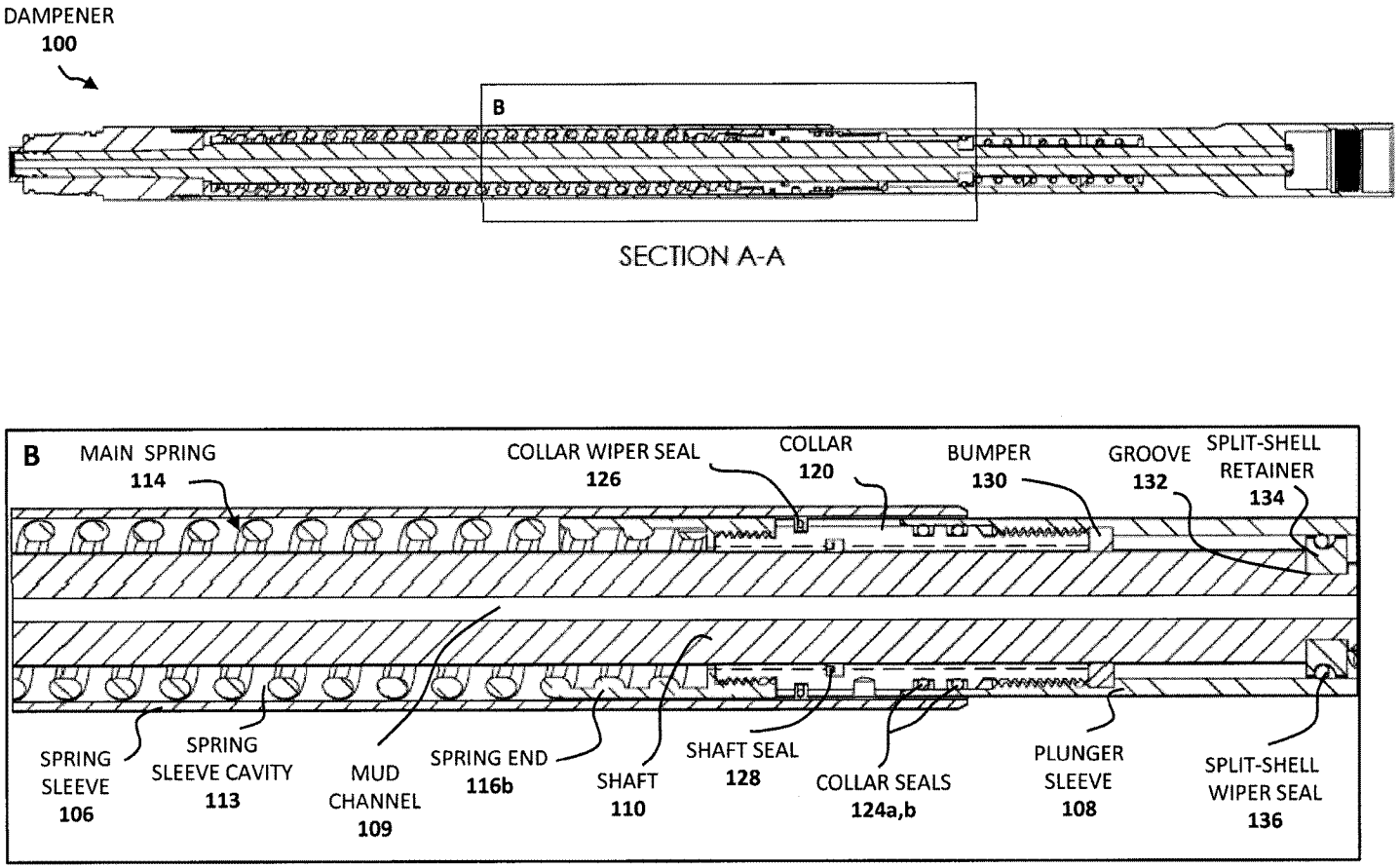
FIG. 3B is the same view of FIG. 2C with a magnified portion B.
Figure 3C:
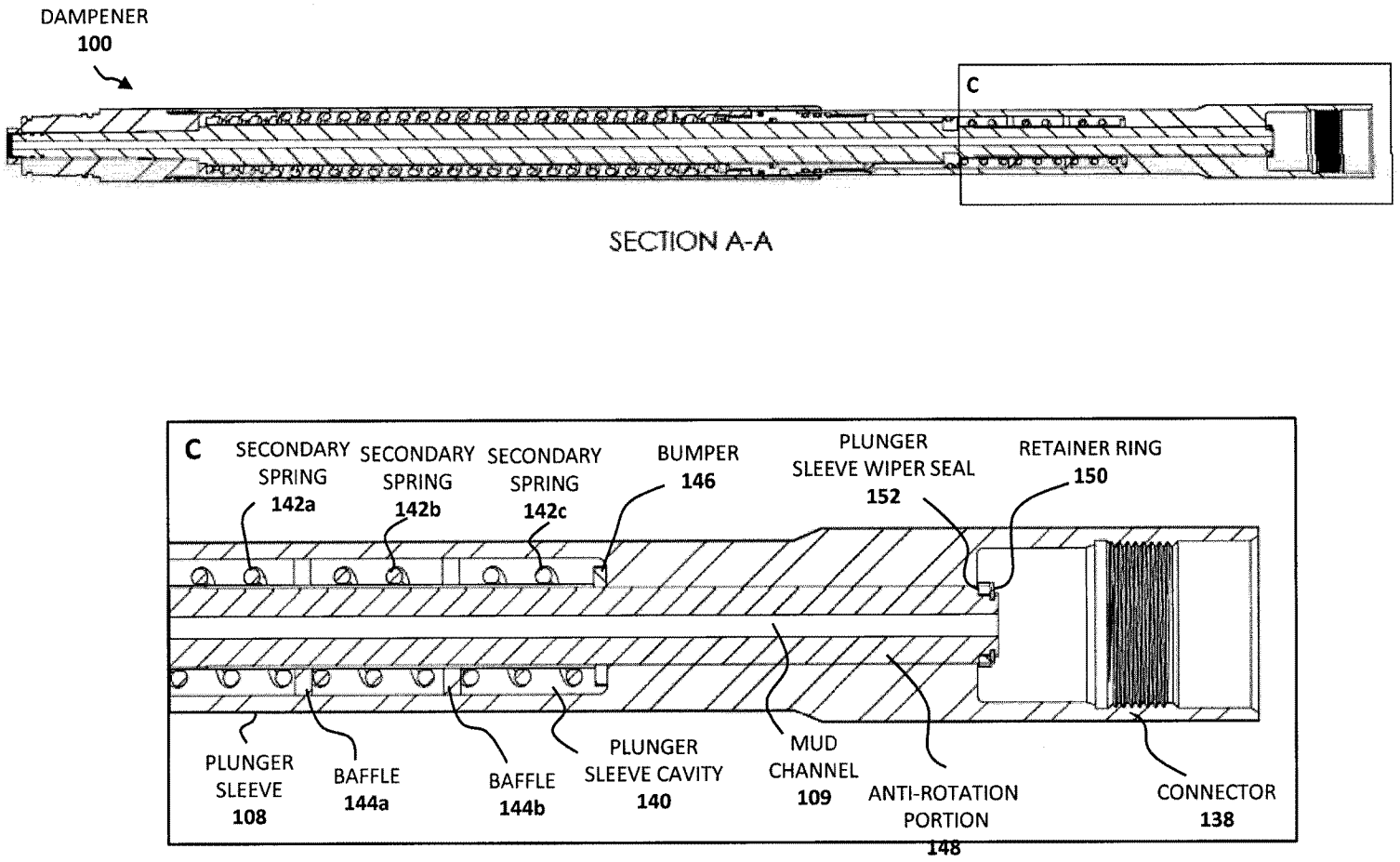
FIG. 3C is the same view of FIG. 2C with a magnified portion C.

Shown in FIG. 3A is a magnified view of the cross sectional view of FIG. 2C, showing the left side of the interior of the dampener 100. It is seen that the nut 104 retains a hollow shaft 110 with a central mud channel 109 in association with the hollow adapter 102. The mud channel 109 provides a conduit for the actuator pulses to move in the drilling fluid (or mud) down to activate the main mud pulse for telemetry.

Figure 4A:
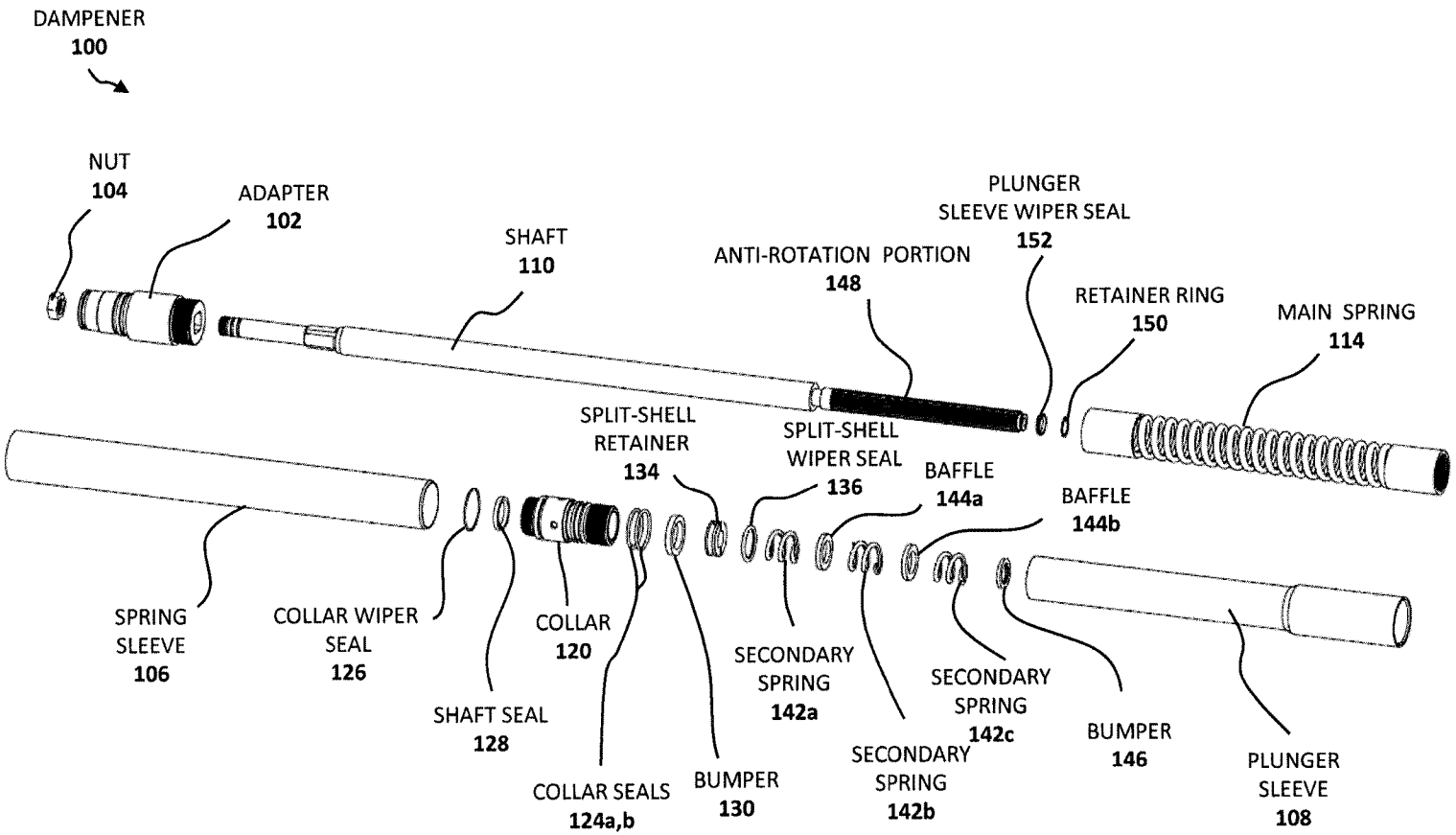
FIG. 4A is a perspective exploded view of the dampener device 100.
Figure 4B:
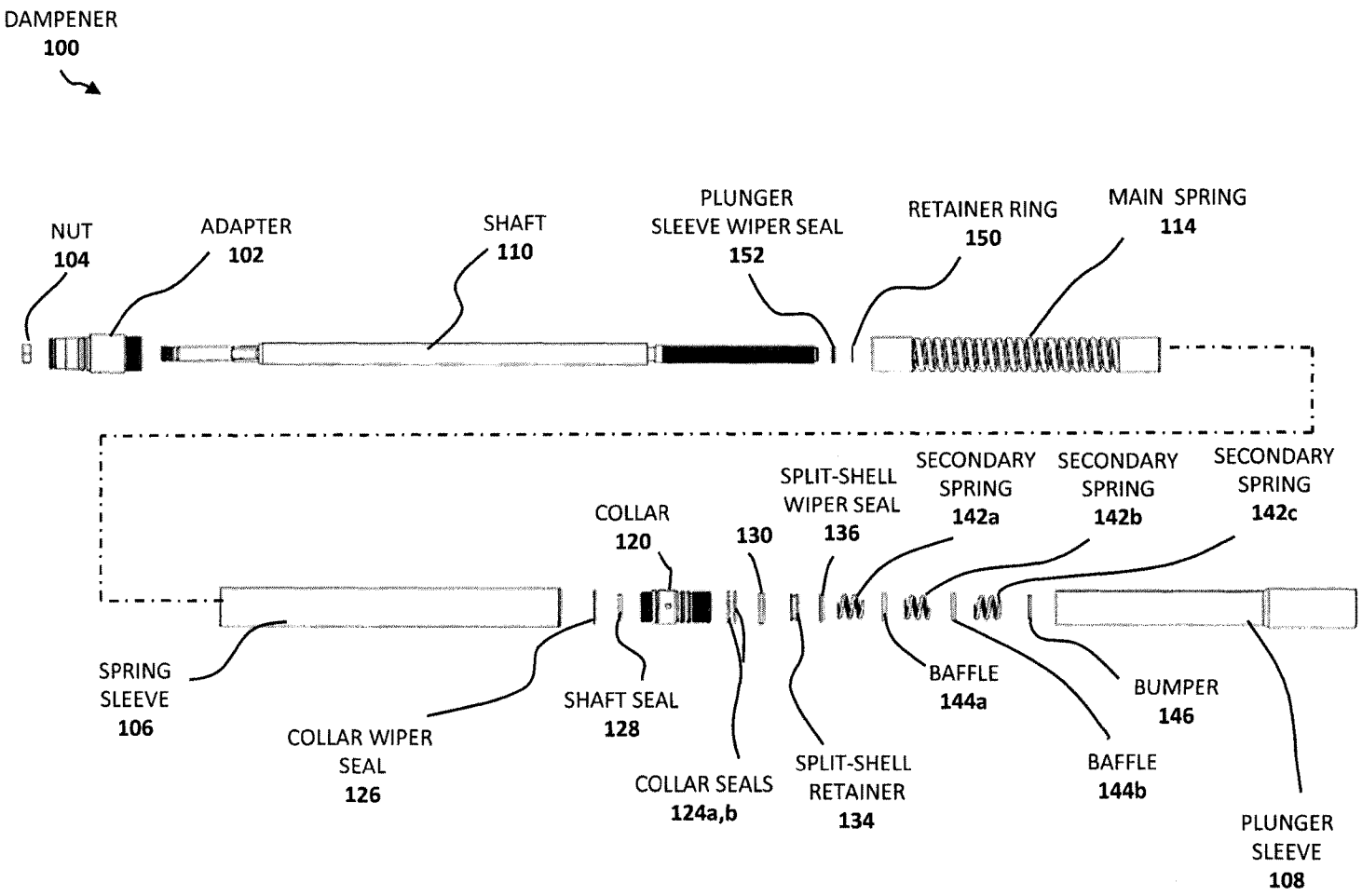
FIG. 4B is a side elevation exploded view of the dampener device 100.
Figure 5B:
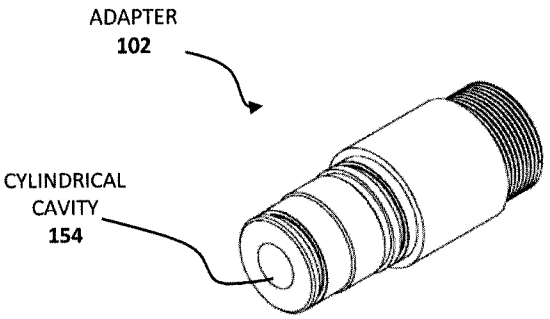
FIG. 5B is another perspective view of the adapter 102 of FIG. 5A.
Figure 5A:
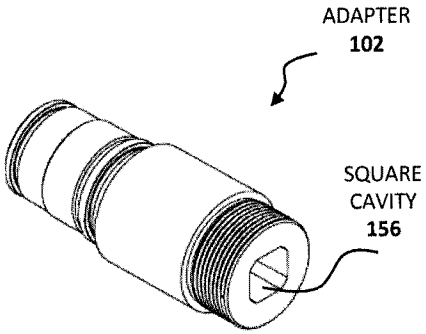
FIG. 5A is a perspective view of an adapter 102 used in the embodiment of FIGS. 2 to 4.

Selected features of the adapter 102 are shown in the perspective views of FIGS. 5A and 5B. In FIG. 5A, the orientation of the adapter 102 is generally similar to the orientation of the adapter 102 shown in FIG. 2A and FIG. 5B is a perspective view representing approximately a 270 degree clockwise rotation of the view of the orientation of FIG. 5A. It is seen that going from left to right of FIG. 5A, the hollow cavity of the adapter includes a transition from a cylindrical shape 154 to a square shape 156. The variation in the shape of the cavity of the adapter 102 is complementary to the shapes of the shaft 110 which is seen in FIGS. 3A to 3C, FIGS. 4A and 4B, and by itself in perspective view in FIG. 6. It is to be understood that the reduced diameter cylindrical end 158 of the shaft 110 fits into the cylindrical cavity 154 of the adapter 102 and the square portion 160 of the shaft 110 fits into the square cavity 156 of the adapter 102 to prevent the shaft from rotating with respect to the adapter 102 and the components connected thereto.

Figure 6A:
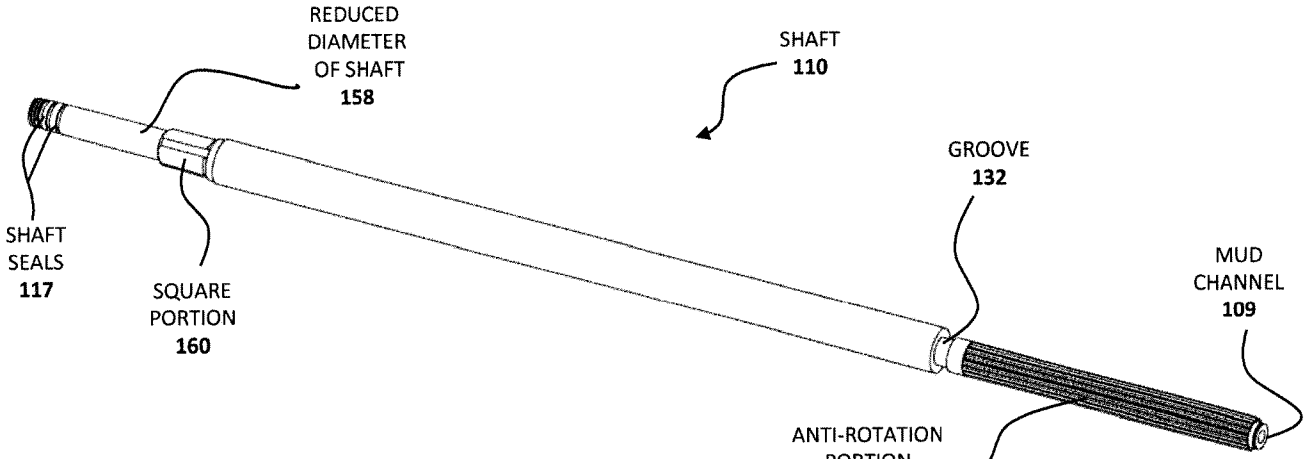
FIG. 6A is a perspective view of a shaft 110 used in the embodiment of FIGS. 2 to 4.
Figure 6B:
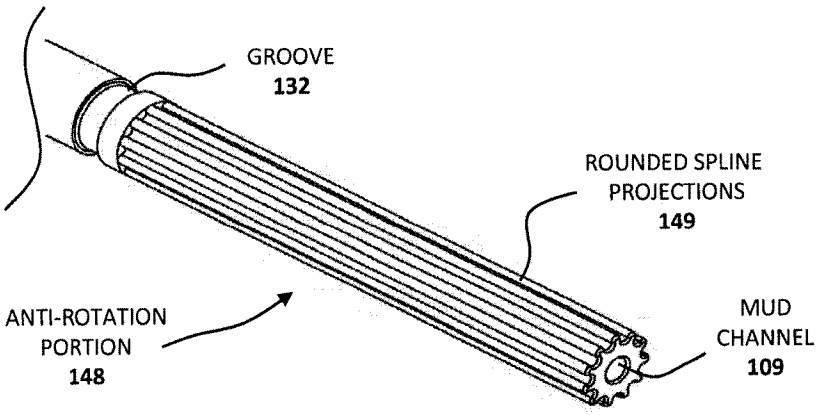
FIG. 6B is a partial perspective view of one end of another shaft embodiment showing detail of the anti-rotation portion 148 which has rounded projections 149.
Figure 9:
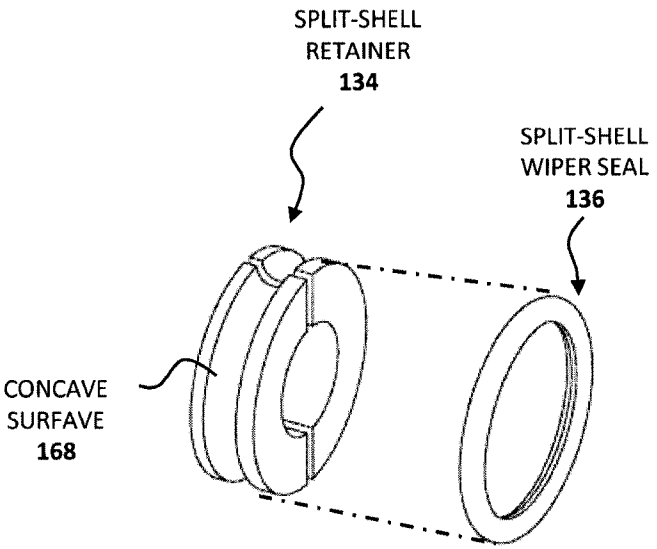
FIG. 9 is a perspective view of the split-shell retainer 134 used in the embodiment of FIGS. 2 to 4 showing also the placement of the split-shell wiper seal 136.

As seen in FIG. 6A, additional features of the shaft 110 include a groove 132 to the left of an anti-rotation portion 148 which in this case is a splined portion with rounded projections 149 (see also the magnified partial perspective view of FIG. 6B). The groove 132 is provided to hold a split-shell retainer 134 (shown in detail in the perspective view of FIG. 9) and the anti-rotation portion 148 of the shaft 110 is provided as another means to prevent rotation of the shaft 110 with respect to the other parts of the dampener 100. The anti-rotation portion 148 is dimensioned to fit within a reduced diameter portion 162 of the interior sidewall of the plunger sleeve 108 which has spline grooves 164 dimensioned to accept the projections of the anti-rotation portion 148 (see FIG. 7 which illustrates a cross-sectional perspective view of the plunger sleeve 108). The complementary spline grooves 164 and projections 149 of the anti-rotation portion 148 cooperate to prevent rotation of the shaft 110 within the plunger sleeve 108 while allowing the plunger sleeve 108 to slide along the entire length of the anti-rotation portion 148, as will be discussed in more detail hereinbelow.

Figure 6D:
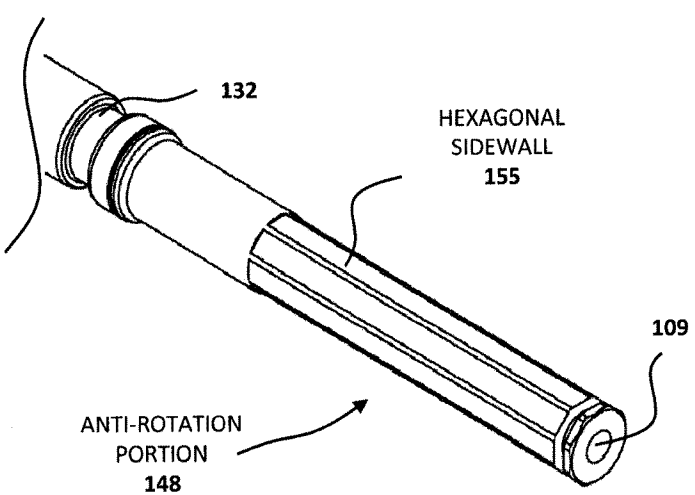
FIG. 6D is a partial perspective view of one end of another shaft embodiment showing detail of the anti-rotation portion 148 which has a hexagonal outer sidewall 155.
Figure 6C:
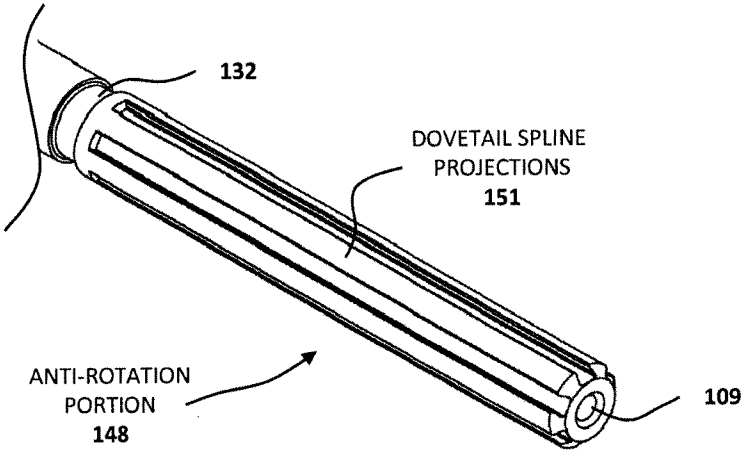
FIG. 6C is a partial perspective view of one end of another shaft embodiment showing detail of the anti-rotation portion 148 which has dovetail projections 149.

Two additional embodiments of the anti-rotation portion 148 of the shaft 110 are shown in partial perspective views in FIGS. 6C and 6D. The anti-rotation portion 148 of FIG. 6C has dovetail projections 151 which match complementary dovetail grooves in a corresponding plunger sleeve (not shown) in a manner similar to the manner in which the spline grooves 164 in the interior of the plunger sleeve 108 in FIG. 7 match the splines of the anti-rotation portion of FIG. 6A. Likewise, the anti-rotation portion 148 of FIG. 6D is provided by a hexagonal outer sidewall 155 which matches a complementary hexagonal inner sidewall within a corresponding plunger sleeve (not shown).

The dovetail projections 151 are expected to represent a particularly effective class of anti-rotation structure because of the large combined surface area presenting resistance to rotation. In addition the rotation forces which would tend to wear down the anti-rotation structure are expected to be dispersed more effectively by the dovetail structure.

Figure 7:
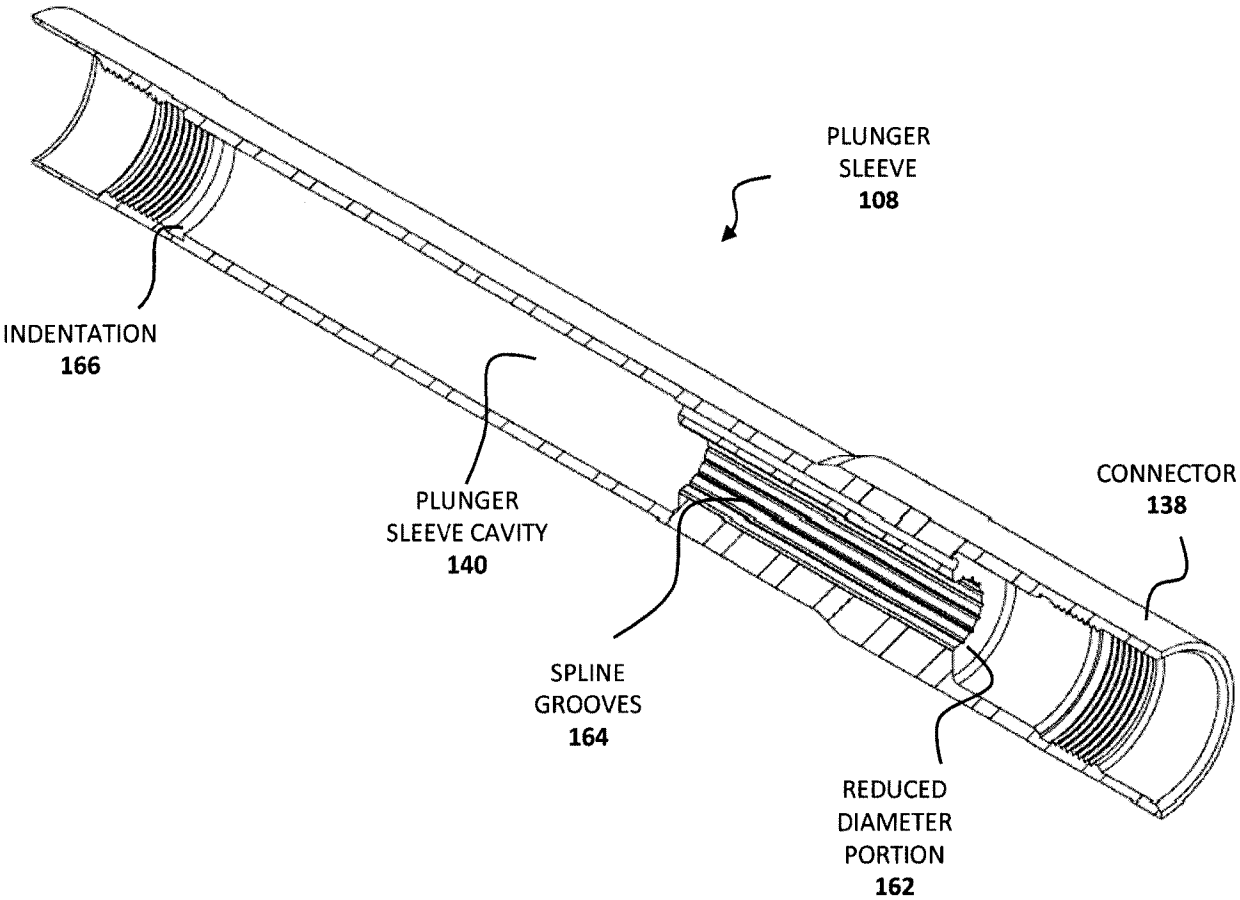
FIG. 7 is a cross sectional perspective view of the plunger sleeve 108 used in the embodiment of FIGS. 2 to 4.

In FIG. 7, it is seen that the inner sidewall of the plunger sleeve cavity 140 also has an indentation 166 to hold a bumper ring which be described hereinbelow.

Returning now to FIG. 3A, it is seen that the right side of the adapter 102 is connected to the main sleeve 106 which has a cavity 113 dimensioned to hold a main spring 114 formed of reinforced opposing ends 116*a* and 116*b* with intervening coils 118. It is seen that the connection of the main sleeve 106 to the adapter 110 is facilitated by provision of threads on the outer sidewall of the right side connecting portion of the adapter 102 which mate with interior sidewall threads of the left end of the main sleeve 106. The reduced diameter portion 158 of the shaft 110 has a pair of grooves adjacent the left end for holding a pair of shaft seals 117 which seal the circumference of the outer sidewall of the reduced shaft diameter of the shaft 158 to the circumference of the cylindrical cavity 154 of the adapter 102.

The middle segment of the three magnified interior segments of the dampener 100 is shown in FIG. 3B. It is seen that the main spring end 116*b* is connected to an interior collar 120. The structure of this embodiment of the collar 120 is shown in perspective view in FIG. 8. A threading connection is provided between the inner sidewall of the spring end 116*b* and the outer sidewall of the left end of the collar 120 is provided to facilitate the process of making the connection. Likewise, a threading connection between the inner sidewall of the plunger sleeve 108 and the outer sidewall of the right end of the collar 120 is provided to make a connection between these components.

Figure 8:
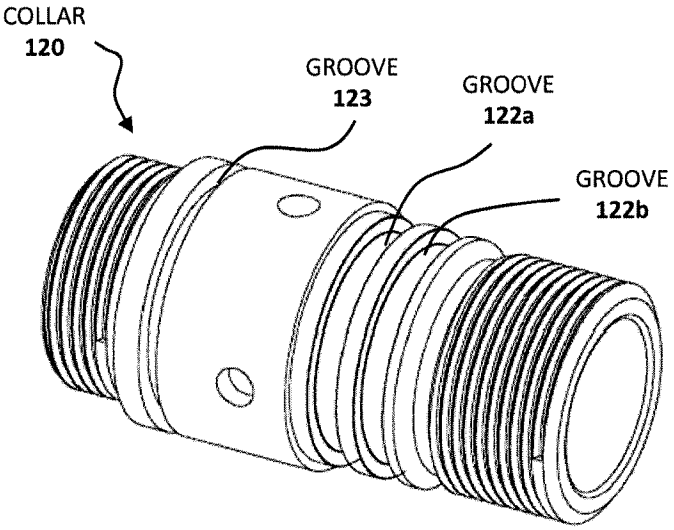
FIG. 8 is a perspective view of the collar 120 used in the embodiment of FIGS. 2 to 4.

It is seen in FIG. 3B and in FIG. 8 that the middle portion of the collar has a wider circumference and is provided with a pair of o-ring grooves 122*a* and 122*b* (shown in FIG. 8) to hold a pair of collar seals 124*a* and 124*b* on the right side and a single wiper seal groove 123 on the left side for holding a collar wiper seal 126. The functions of the collar wiper seal 126 and other wiper seals will be described in more detail hereinbelow. Additionally, the interior sidewall of the collar 120 is provided with a groove (not shown) for holding a shaft seal 128 (see FIGS. 3B, 4A and 4B). It is seen in FIG. 3B that a bumper 130 in the shape of a ring formed of rubber or other suitable material is placed over the shaft 110 adjacent to the right end of the collar 120. The function of the bumper 130 is to restrict excessive axial compression movement of the plunger sleeve 108 as will be described in more detail hereinbelow.

It is also seen in FIG. 3B and in FIG. 6 that the shaft 110 has an intermediate circumferential groove 132. The groove 132 is provided for placement of a split-shell retainer 134 which has a concave surface 168 for holding a split-shell wiper seal 136 (see FIG. 9). The split-shell retainer 134 and the split-shell wiper seal 136 are also seen on the right side of the magnified cross-sectional view of FIG. 3B and in the exploded views of FIG. 4A and 4B.

FIG. 3C is a magnified view of the rightmost end of the dampener 100 in the orientation shown). The outer surface of this end of the dampener 100 is formed by the outer wall of the plunger sleeve 108 whose right end is formed by a wider circumference portion representing the threaded connector 138 described above, which is provided for making a connection to a main pulser unit for generation of the mud pulses used in measurement-while-drilling telemetry. It is seen in this view that the plunger sleeve 108 has an inner cavity 140 which holds the anti-rotation portion 148 of the shaft 110.

The sidewall of the cavity 140 has a wider circumference on the left side of the plunger sleeve 108 which forms a secondary cavity for holding three secondary springs 142*a*, 142*b* and 142*c* which together with a pair of intervening ring-shaped baffles 144*a* and 144*b* collectively provide an additional dampening effect as described in detail hereinbelow. The anti-rotation portion 148 of the shaft 110 passes through the central opening of each of the baffles 144*a* and 144*b*. A ring-shaped bumper 146 formed of rubber or other resilient material is located at the point where the circumference of the plunger sleeve cavity 140 transitions from a wider to a narrower circumference. In an alternative embodiment (not shown) the three secondary springs 142*a*, 142*b* and 142*c* are replaced with a single secondary coil spring having approximately the same combined length of the three secondary springs 142*a*, 142*b* and 142*c*. In this alternative embodiment, the three separate baffles 144*a*, 144*b* and 144*c* are replaced with an elastomeric ribbon configured to be interwoven between the coils of the single secondary coil spring to provide further support to the spring and to act as a wiper seal to prevent particulate matter in the drilling fluid from reaching the shaft 110 and the inner portions of the secondary coil spring. In some embodiments, the elastomeric ribbon is formed of Viton® rubber or other similarly compressible material.

The right end of the anti-rotation portion 148 of the shaft 110 is provided with a retainer ring 150. This is also shown in the partial perspective view of the connector 134 and plunger sleeve 108 in FIG. 10. A plunger sleeve wiper seal 152 is located between the retainer ring 150 and the end of the anti-rotation portion 148. The function of this wiper seal 152 and the other wiper seals 126 and 136 will be described in more detail hereinbelow.

Operation of the First Embodiment of the Dampener Device

With reference to FIGS. 1 to 11 the operation of the dampener 100 as part of the measurement-while drilling system of FIG. 1 will now be described. During the drilling process, the drilling mud circulates down the drill string to lubricate the drill bit 12 and upward to carry drill cuttings up to the surface. The drilling mud also propagates signals to the surface which encode data recorded by the instrumentation 20, as a series of pulses which are actuated by the pulse servo driver 18 and generated by the pulser unit 16 when the measurement-while-drilling tool 10 is operating. The propagation of the mud pulses through the dampener 100 located between the pulse servo driver 18 and the pulser 16 occurs via mud channel 109 in the shaft 110 of the dampener 100. Axial, lateral and torsional shocks to the drill string are generated during the drilling process. The dampener 100 is provided to absorb these shocks and prevent damage to the instrumentation module 20.

The plunger sleeve wiper seal 152 near the downhole end of the dampener 100 (best seen in FIG. 10) permits drilling mud to enter the space between the anti-rotation portion 148 of the shaft 110 and the plunger sleeve cavity 140. The pressure of the drilling mud is sufficient to drive drilling mud into the plunger sleeve cavity 140 to fill the spaces between the anti-rotation portion 148 of the shaft 110, the secondary springs 142*a*, 142*b* and 142*c*, and the baffles 144*a* and 144*b*. The drilling mud also moves past the split-shell wiper seal 136 at the end of the anti-rotation portion 148, and past the collar wiper seal 126 and into the main sleeve cavity 113. Additionally, the drilling mud can enter the space between the outer sidewall of the plunger sleeve 108 and the inner sidewall of the main sleeve 106 where it will move past both the split-shell wiper sleeve 136 and the collar wiper seal 126. The three wiper seals 126, 136 and 152 are provided to allow passage of drilling fluid into and out of the dampener device and to prevent passage of particulate matter that can damage the interior components of the dampener 100. As such, drilling mud substantially fills all of the interior cavities of the dampener 100 to act as dampening fluid.

Figure 10:
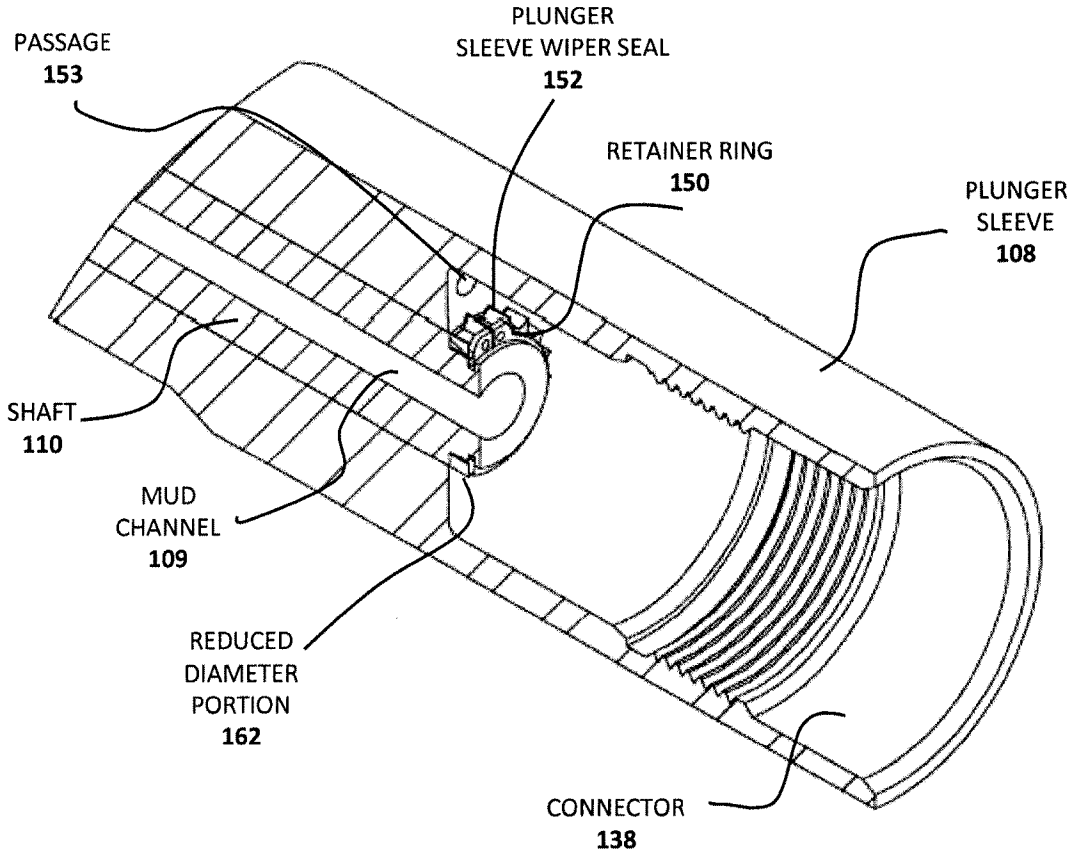
FIG. 10 is a partial cross-sectional perspective view of the plunger sleeve 108 of the embodiment of FIGS. 2 to 4 showing the arrangement of the plunger sleeve wiper seal 152 and retainer ring 150 with respect to the end of the shaft 110 adjacent to the threaded connector 138.

It is seen in FIG. 10 that the outer end of the interior reduced diameter portion 162 of the plunger sleeve 108 has a passage 153 leading to the cavity 140 of the plunger sleeve 108. This passage 153 is to allow drilling fluid to enter the cavity 140.

Resonance frequency is dampened by the fluid flow restrictions. At equilibrium the main coil spring 114 is at rest is in an extended state while the secondary springs 142*a-c* are in a slightly compressed state. When under full compression, the main coil spring 114 and the secondary springs 142*a-c* are compressed. In some examples of prior art dampening devices, the dampening function is served by the presence of a permanent volume of hydraulic fluid in sealed spaces. The inventors have recognized that drilling mud can serve the same function and this allows a simpler dampener design which is less costly to manufacture and maintain.

Figure 11A:
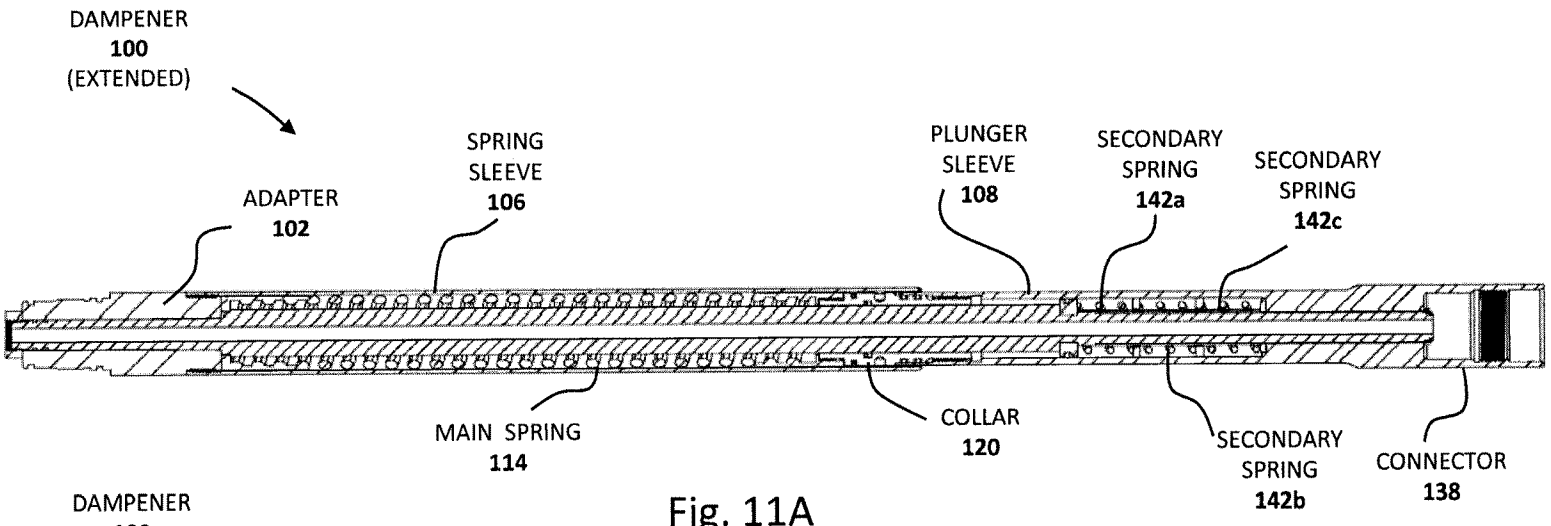
FIG. 11A is a cross-sectional view of the dampener 100 similar to that of FIG. 2 showing the dampener device 100 in an extended state.
Figure 11B:
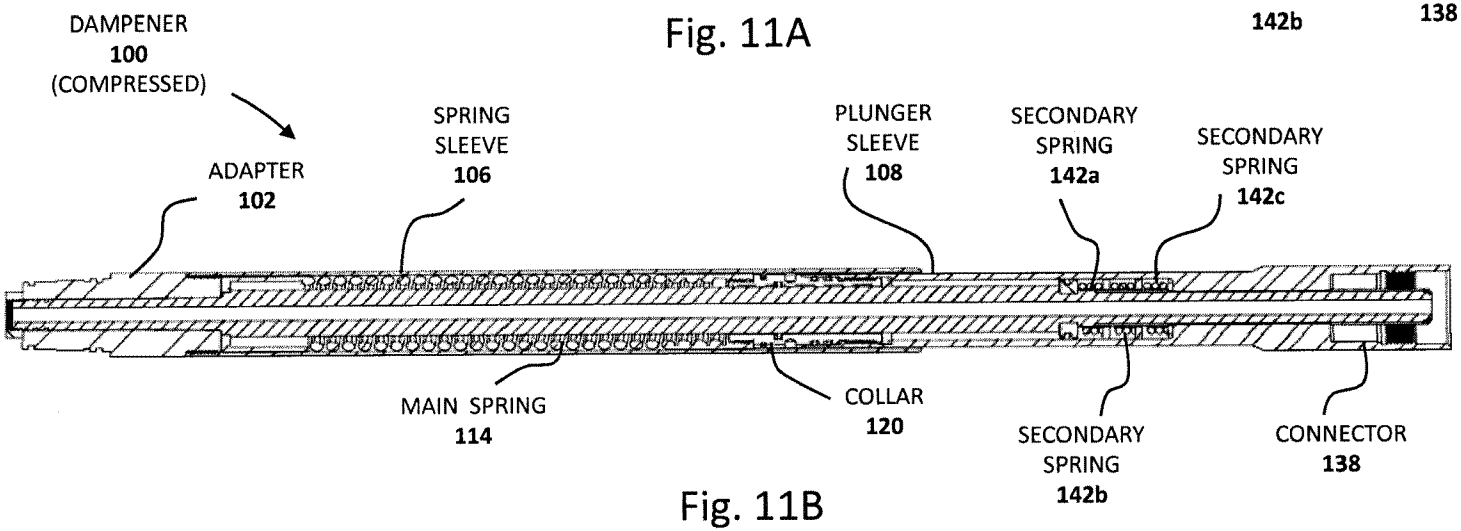
FIG. 11B is a cross-sectional view of the dampener 100 similar to that of FIG. 2 showing the dampener device 100 in a compressed state.

The dampening functions will now be described in detail. Firstly, it is to be noted that the left end of the shaft 110 is fixed to the adapter 102, the leftmost main spring end 116*a* is fixed to the adapter 102, the rightmost main spring end 116*b* is fixed to the left end of the collar 120, and the left end of the plunger sleeve 108 is fixed to the right end of the collar 120. The widest part of the collar 120 is slidable within the cavity of the main sleeve 106. Therefore, the left end of the plunger sleeve 108 can be pushed into the main sleeve cavity 113 and compress the main spring 114 contained therein. The shaft 110 remains stationary as the plunger sleeve 108 moves past it. A compressed state of the dampener device 100 is shown in FIG. 11B with an extended state also shown in FIG. 11A to facilitate a comparison.

The shaft 110 functions as a torsion bar to resist torsional shocks to the drill string which occur during drilling. For example, if the drill bit is temporarily stuck and fails to rotate for a short time, the rotating drill collars above the instrumentation module will continue to rotate under momentum and transmit shock to the instrumentation module. The shaft 110 has sufficient elasticity to twist without rotating such that the shock of temporary momentum loss is absorbed. The complementary square portion 160*b* of the shaft and square cavity 156 of the adapter 102 and the complementary anti-rotation portion 148 and spline grooves 164 of the plunger sleeve cavity 140 each serve as anti-rotation features. The skilled person will recognize that other complementary shapes can be provided instead of square and splined shapes to provide anti-rotation features to the shaft 110. In certain embodiments, the shaft is formed of a material with a modulus of elasticity that allows a degree of absorption of torsion before returning the shaft 110 to its original shape. In certain embodiments, the modulus of elasticity is 113.8 GPa or between about 102.4 GPa to about 125.2 GPa. In some embodiments, the shaft is formed of any alloy with a modulus of elasticity in the range described above. In certain embodiments, the alloy is a titanium alloy known as Titanium Ti-6Al-4V.

The main spring 114 provides a dynamic opposing force to mass moving axially in upward and downward directions from vibration and shock caused by the drilling operation. The combination of the secondary springs 142*a*, 142*b* and 142*c* and the baffles 144*a* and 144*b* provide additional opposing force to the gravitational downward forces which will compress the springs. Simultaneously the main spring 114 resists in both downward (compression) and extension (upward) directions.

There are a number of differences between prior art dampening devices and the first embodiment described herein. The first embodiment uses drilling mud in the cavities of the dampener as a dampening medium instead of a sealed volume of hydraulic fluid. Baffles are provided in the plunger sleeve cavity to further restrict fluid flow to enhance dampening. The main spring acts in both extension and compression modes to dynamically resist external shocks while the secondary springs surrounded by drilling mud act collectively to resist compression. Rotational torque dampening is primarily provided by the elasticity of the rotation-restricted shaft acting as the torsion bar. There is no requirement for a sealed pressure compensation piston and as such, the first embodiment of the dampener is of simpler construction with field serviceable and replaceable parts.

Structural Features a Second Embodiment of the Dampener

A second embodiment of the dampener 200 will now be described with reference to FIGS. 12 to 15. Components of this embodiment 200 are identified using reference numerals of the 200 series. To facilitate recognition of functional features, features providing generally similar functions to those of the first embodiment are identified using similar reference numerals, wherever possible. For example, in the first embodiment, the main sleeve is identified by reference numeral 106 and in the second embodiment, the main sleeve is identified by reference numeral 206.

Figure 12A:
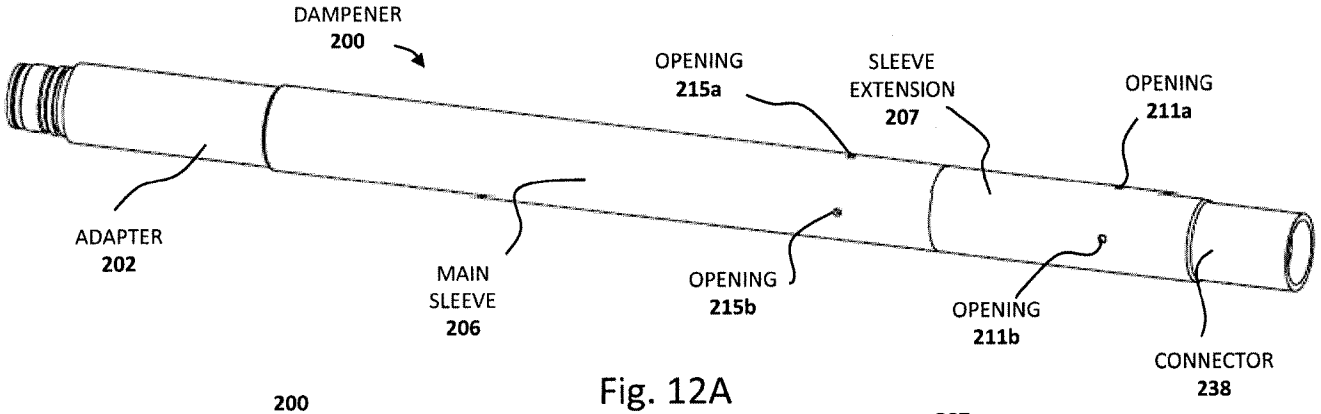
FIG. 12A is a perspective view of a dampener device 200 of a second embodiment of the invention.
Figure 12B:
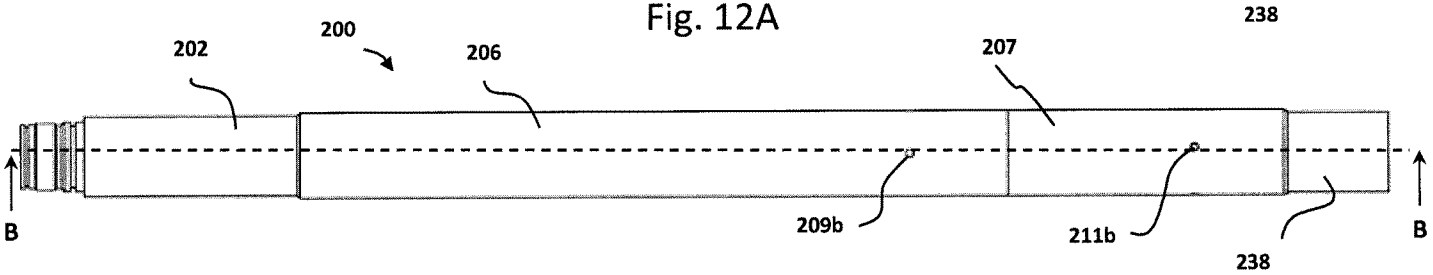
FIG. 12B is a plan view of the embodiment of the dampener device 200 shown in FIG. 12A.
Figure 12C:
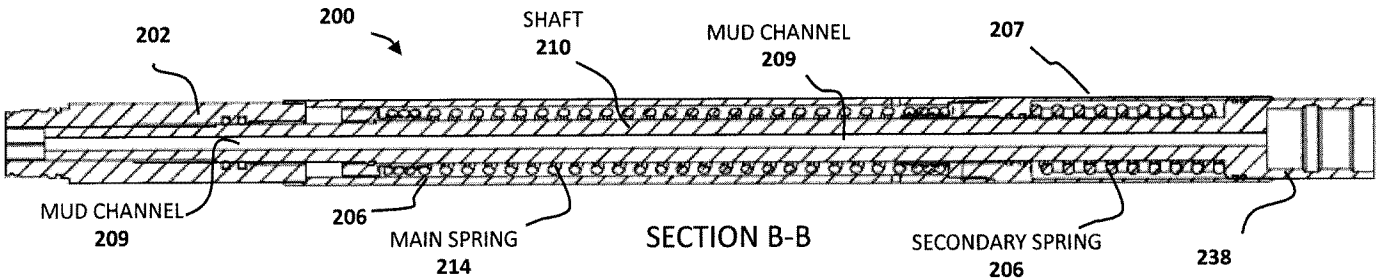
FIG. 12C is a cross sectional view of taken along line B-B of FIG. 12B.

Turning now to FIG. 12A, there is shown a perspective view of a second embodiment of the dampener 200 which is shown in generally the same orientation as that of the first embodiment in FIG. 2A. From right to left, the dampener 200 has a connector 238 a sleeve extension 207, a main sleeve 206 and an adapter 202. The connector 238 is configured for connection to a downhole measurement-while-drilling tool assembly and the adapter 202 is configured for connection to an uphole instrumentation module (see FIG. 1 for the general arrangement). Two openings 215*a* and 215*b* are visible in the outer wall of the main sleeve 206 and two additional openings 211*a* and 211*b* are visible in the sleeve extension 207. These openings 215*a*, 215*b*, 211*a* and 211*b* are provided for the purpose of allowing drilling fluid to enter the cavities of the main sleeve 206 and the sleeve extension 207 to act as dampening fluid. The same components are visible in the side elevation view shown in FIG. 12B provided for the purpose of showing the cut at lines B-B for the cross section shown in FIG. 12C. FIG. 12C shows selected components in cross section, including the shaft 210 (with more cross sectional detail described in FIGS. 15A to 15C described below).

Figure 13:
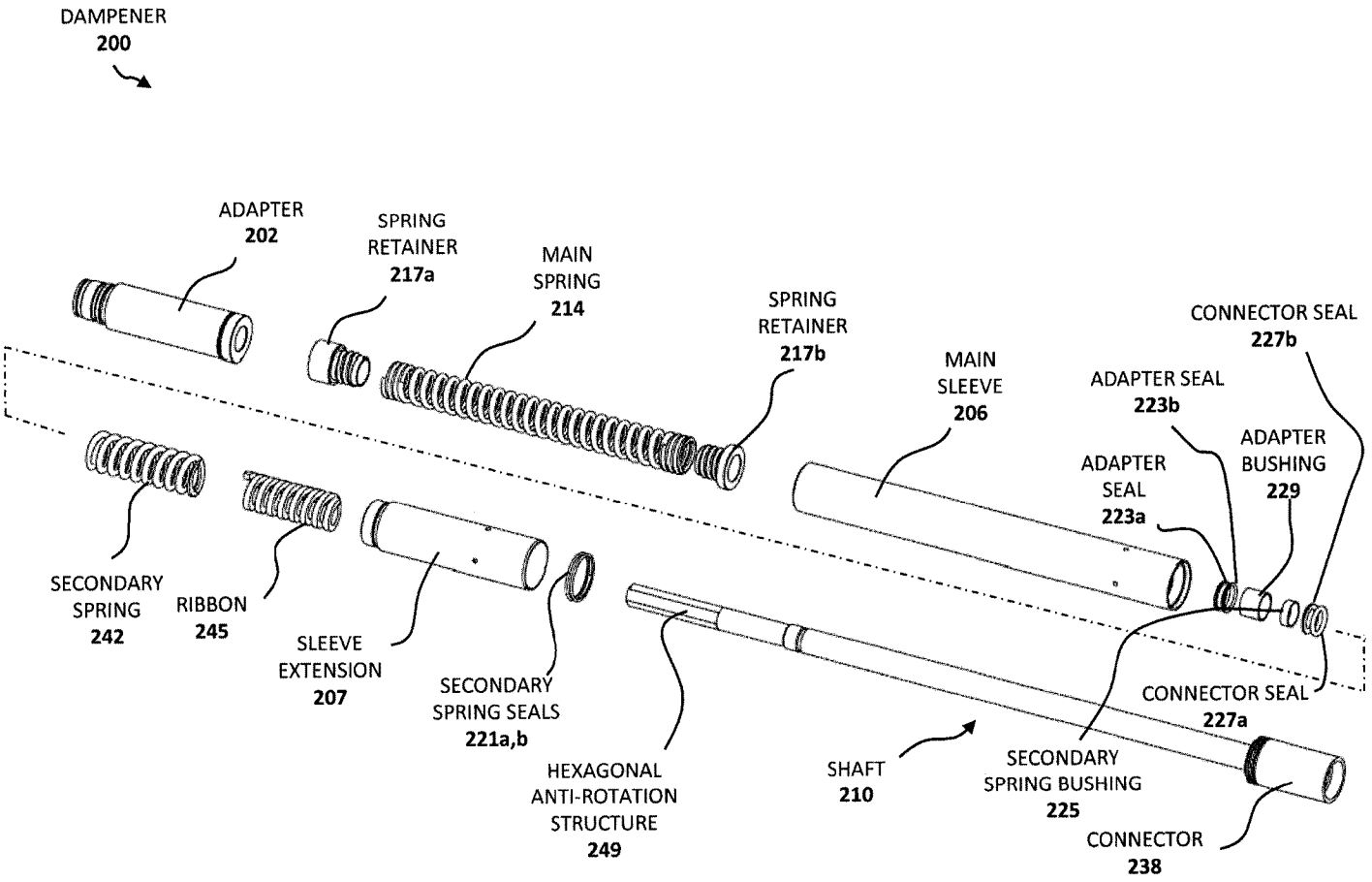
FIG. 13 is a perspective exploded view of the dampener device 200.
Figure 14A:
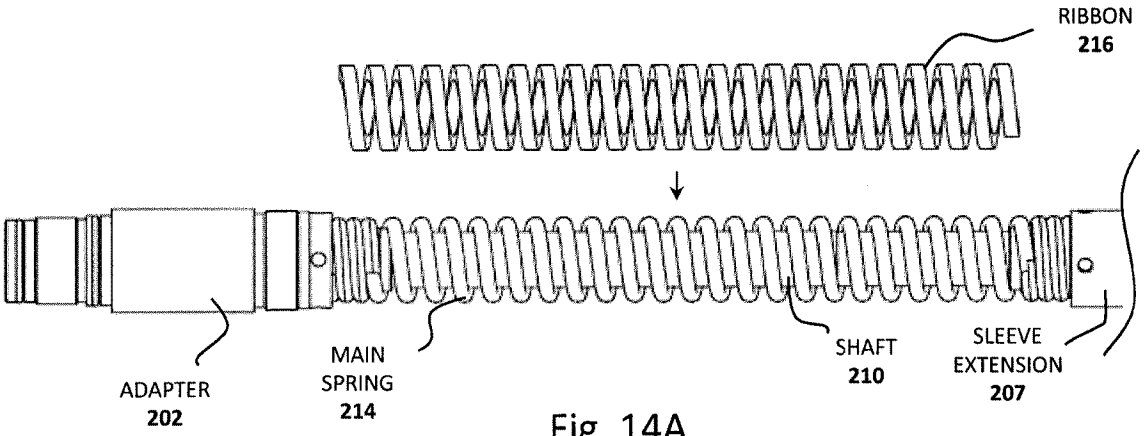
FIG. 14A is a partial plan view of one end of the dampener device 200 the main sleeve 206 removed to show the main spring 214 an the manner of insertion of an elastomeric ribbon 216 between the coils of the main spring 214.
Figure 14B:
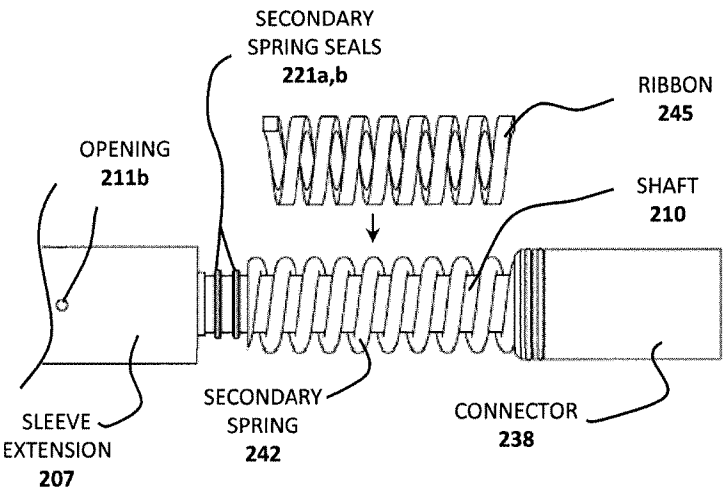
FIG. 14B is a partial plan view of one end of the dampener device 200 with the sleeve extension 207 separated from the connector 238 showing the manner of insertion of an elastomeric ribbon 245 between the coils of the secondary spring 242.

FIG. 13 is an exploded perspective view of the second embodiment of the dampener 200 in generally the same arrangement as that of FIG. 4A. This view indicates a number of different component characteristics relative to the components of the first embodiment of the dampener 100. For example, the connector 238 is integrally formed with (e.g., formed monolithically relative to, in a unitary manner relative to, or as one-piece with) the shaft 210. This connector 238 is configured for attachment to the downhole tool assembly in a similar manner as connector 138 of the first embodiment of the dampener 100. In the second embodiment of the dampener 200, the shaft 210 itself acts as a plunger component and influences the extension and compression of the main spring 214 and the secondary spring 242. The main spring 214 resides in the cavity of the main sleeve 206 and has two separate spring retainers 217*a* and 217*b*. A coiled ribbon 245 formed of Viton® rubber or other similarly compressible material is interwoven with the coils of the secondary spring 242 as shown more clearly in FIG. 14B. This secondary spring connector 238 and ribbon 245 combination resides within the cavity of the sleeve extension 207.

In one variation based on the second embodiment, the main spring 214 also has an elastomeric ribbon 216 formed of Viton® rubber or other similarly compressible material interwoven between its coils to provide similar support and wiper seal functions as described above for the single secondary spring (see FIG. 14A). As readily recognizable by the skilled person, and while not specifically shown in the Figures, a similar elastomeric ribbon may similarly be provided for the main spring 114 as well as the secondary spring(s) 142 of the first embodiment 100 of the dampener. These embodiments, which provide an elastomeric ribbon interleaved between the coils of the springs generally provide additional dampening of vibrations, cushion extreme compression on the coils of the springs and also prevent particulates from entering the spaces between the coils and the outer sidewall of the shaft. In some embodiments based on either the first or second embodiment described herein, the elastomeric ribbon is pre-formed in coils to facilitate its insertion into the spaces between the coils of the main spring and/or the secondary spring(s).

The shaft 210 has an anti-rotation structure 249 nearest to its left end (in the orientation of FIG. 13) which is hexagonal and configured to fit in a complementary hexagonal cavity of the adapter 202 (not shown). Alternative embodiments have different anti-rotation structures with different shapes such as spline projections. The anti-rotation structure 249 prevents rotation of the shaft 210 in a manner similar to the anti-rotation structure 148 of the first embodiment of the dampener 100.

Also shown in FIG. 13 are seals and bushings, including adapter seals 223*a* and 223*b*, adapter bushing 220, connector seals 227*a* and 227*b*, secondary spring bushing 225 and secondary spring seals 221*a* and 221*b*. The bushings 220 and 225 are provided to allow sliding motion and the seals 223*a*, 223*b*, 221*a*, 221*b*, 227*a* and 227*b* are provided to prevent passage of particulates contained in the drilling fluid from entering areas of the dampener 200 which could be damaged by such particulates.

Figure 15A:
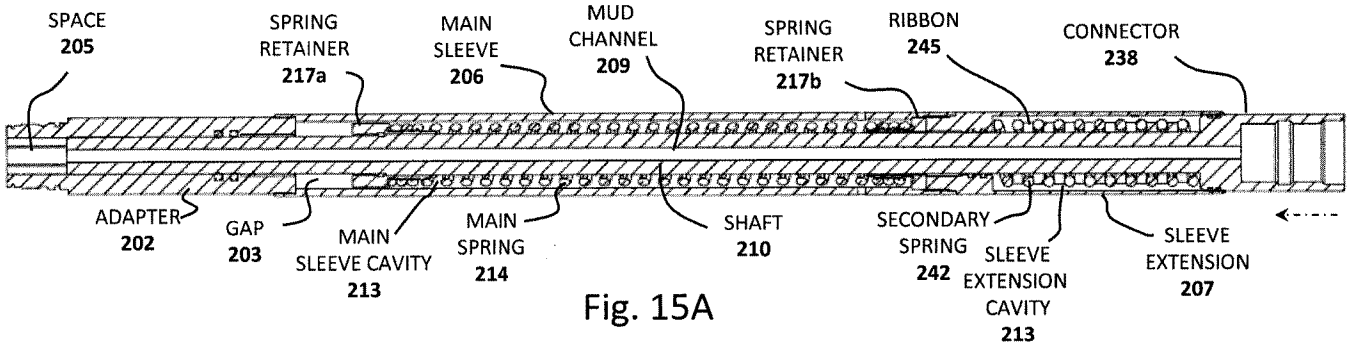
FIG. 15A is a cross-sectional view of the dampener device 200 similar to that of FIG. 12C showing the dampener device 200 in an extended state. A gap 203 is visible in the main sleeve cavity 213 between the right end of the adapter 202 and the left end of the spring retainer 217*a* and a space 205 is visible between the left end of the adapter 202 and the left end of the shaft 210.
Figure 15B:
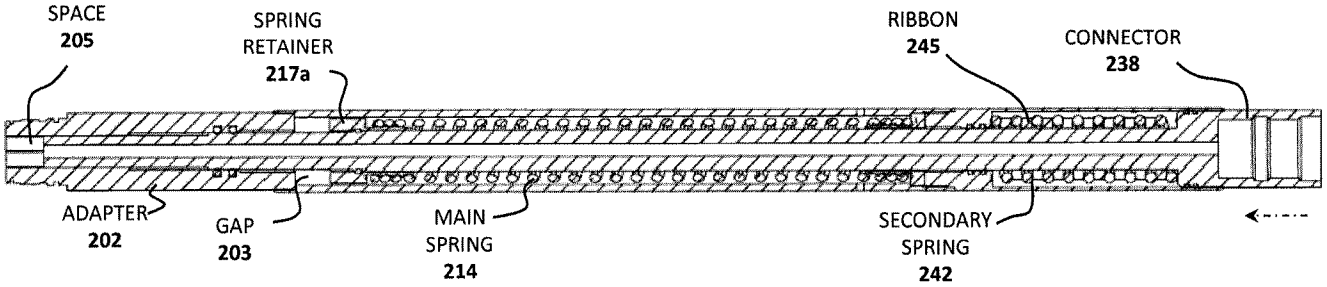
FIG. 15B is another cross-sectional view of the dampener 200 in a partially compressed state wherein the gap 203 and the space 205 are smaller as a result of the shaft moving from right to left.
Figure 15C:
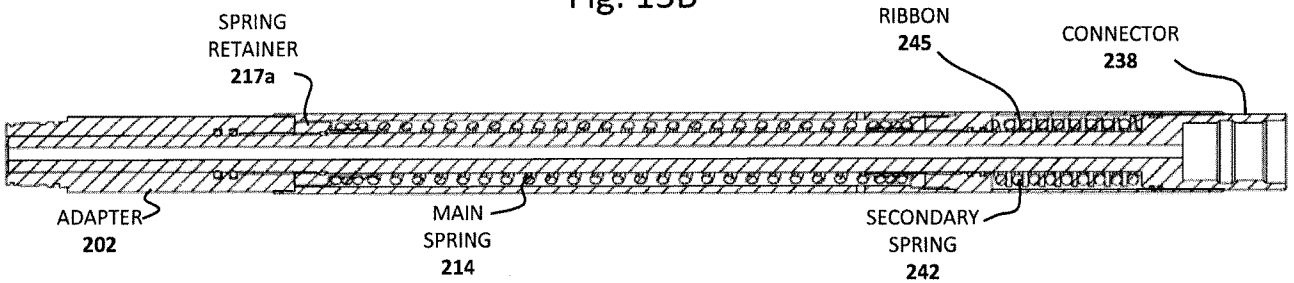
FIG. 15C is another cross-sectional view of the dampener 200 in a state which is more compressed than the state shown in FIG. 15B. The gap 203 is closed by contact of the left end of the spring retainer 217*a* with the right end of the adapter 202 and the space 205 is completely filled by the left end of the shaft 210.

Three cross sectional views of the dampener 200 are shown in FIGS. 15A, 15B and 15C. FIG. 15A represents the fully extended dampener 200, FIG. 15B is a partially compressed species with a length of approximately 85% of the length of the fully extended dampener and FIG. 15C is an even more compressed species with a length of approximately 76% of the of the length of the fully extended dampener 200.

Connections between the major components of this embodiment of the dampener 200 will now be described. The spring retainer 217*a* has inner threads configured to thread onto the shaft 210 to the right of the hexagonal anti-rotation portion 249. As such, the main spring 214 travels along with movement of the shaft 210. The main sleeve 206 and the sleeve extension 207 are connected and do not move with respect to each other. The shaft 210 which resides within the cavity 240 of the sleeve extension 207 and the cavity 213 of the main sleeve 206 is moveable therein. The inner cavity of the sleeve extension 207 is sufficiently wide to allow entrance of the connector 238 of the shaft 210. This may be seen in a comparison of FIGS. 15A, 15B and 15C.

Operation of the Second Embodiment of the Dampener Device

With reference to FIGS. 12 to 15 the operation of the dampener 200 as part of the measurement-while drilling system of FIG. 1 will now be described. During the drilling process, the drilling mud circulates down the drill string to lubricate the drill bit 12 and upward to carry drill cuttings up to the surface. The drilling mud also propagates signals to the surface which encode data recorded by the instrumentation 20, as a series of pulses which are actuated by the pulse servo driver 18 and generated by the pulser unit 16 when the measurement-while-drilling tool 10 is operating. The propagation of the mud pulses through the dampener 200 located between the pulse servo driver 18 and the pulser 16 occurs via mud channel 209 in the shaft 210 of the dampener 200. Axial, lateral and torsional shocks to the drill string are generated during the drilling process. The dampener 200 is provided to absorb these shocks and prevent damage to the instrumentation module 20.

The openings 215*a* and 215*b* in the main sleeve 206 and the openings 211*a* and 211*b* in the sleeve extension 207 of the dampener 200 (best seen in FIG. 12A) permit drilling mud to enter the main sleeve cavity 213 and the sleeve extension cavity 240 (see FIG. 15A). The pressure of the drilling mud is sufficient to drive drilling mud into these cavities 213 and 240 to surround the main spring 214 and the secondary spring 242 with its interwoven ribbon 245. Seals 223*a*, 223*b*, 221*a*, 221*b*, 227*a* and 227*b* are provided to prevent passage of particulates contained in the drilling fluid from entering areas of the dampener 200 which could be damaged by such particulates. As such, drilling mud substantially fills all of the interior cavities of the dampener 200 to act as dampening fluid.

Resonance frequency is dampened by the fluid flow restrictions. At equilibrium the main coil spring 214 is at rest is in an extended state and the secondary spring 242 is also extended (see FIG. 15A).

In FIG. 15B, it is apparent that the connector 238 has moved further into the cavity of the sleeve extension 207 relative to its position in FIG. 15A and in FIG. 15C, this movement has progressed even further. The effect of this movement is to compress the secondary spring 242 and the interwoven ribbon 245.

It is seen in FIG. 15A that the cavity 213 of the main sleeve 206 has a gap 203 between spring retainer 217*a* and the right end of the adapter 202. In FIG. 15B, the gap 203 becomes smaller in volume as the main spring 214 and connected shaft 210 move to the left. The main spring 214 does not compress at this stage because its left end is moving into the gap 203 and there is thus no barrier to block sliding movement of the spring at this point. Finally, in FIG. 15C the gap 203 disappears as the spring retainer 217*a* reaches the right end of the adapter 202. Further movement of the shaft 210 towards the left results in compression of the main spring and further compression of the secondary spring 242. This dynamic process can also be seen when comparing the three cross sections of FIGS. 15A, 15B and 15C with the space 205 at the left end of the cavity of the adapter 202 becoming smaller in volume in FIG. 15B as the left end of the shaft 210 moves into it. The space 205 is completely filled by the shaft in FIG. 15C.

The shaft 210 functions as a torsion bar to resist torsional shocks to the drill string which occur during drilling in a manner similar to that described for the first embodiment. For example, if the drill bit is temporarily stuck and fails to rotate for a short time, the rotating drill collars above the instrumentation module will continue to rotate under momentum and transmit shock to the instrumentation module. The shaft 210 has sufficient elasticity to twist without rotating such that the shock of temporary momentum loss is absorbed. The hexagonal anti-rotation structure 249 of the shaft 210 and its complementary hexagonally-shaped inner sidewall of cavity (not shown) of the adapter 202 serve as an anti-rotation feature. The skilled person will recognize that other complementary shapes can be provided instead of the hexagonal shape to provide anti-rotation features to the shaft 210. In certain embodiments, the shaft is formed of a material with a modulus of elasticity that allows a degree of absorption of torsion before returning the shaft 210 to its original shape. In certain embodiments, the modulus of elasticity is 113.8 GPa or between about 102.4 GPa to about 125.2 GPa. In some embodiments, the shaft is formed of any alloy with a modulus of elasticity in the range described above. In certain embodiments, the alloy is a titanium alloy known as Titanium Ti-6Al-4V.

The main spring 214 provides a dynamic opposing force to mass moving axially in upward and downward directions from vibration and shock caused by the drilling operation. The combination of the secondary spring 242 and the rubber ribbon 245 provides additional opposing force to the gravitational downward forces which will compress the springs. Simultaneously the main spring 214 resists in both downward (compression) and extension (upward) directions.

Structural Features of a Third Embodiment of the Dampener Device

Figure 17A:
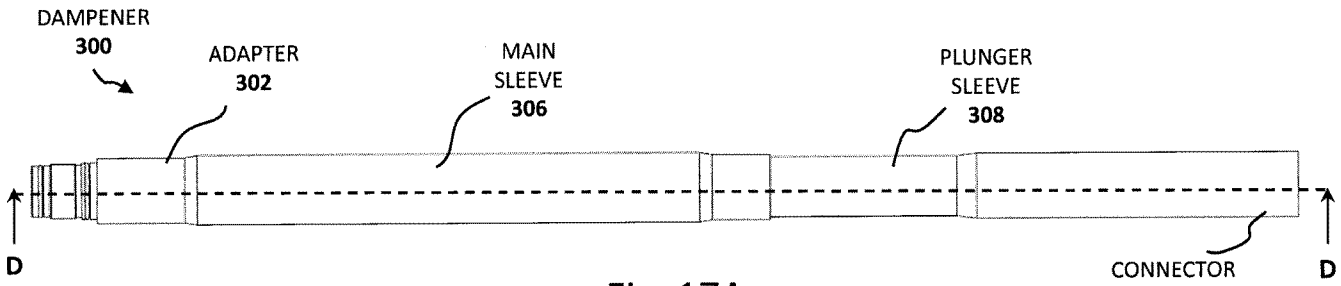
FIG. 17A is a plan view of a third embodiment 300 of the dampener.
Figure 17B:
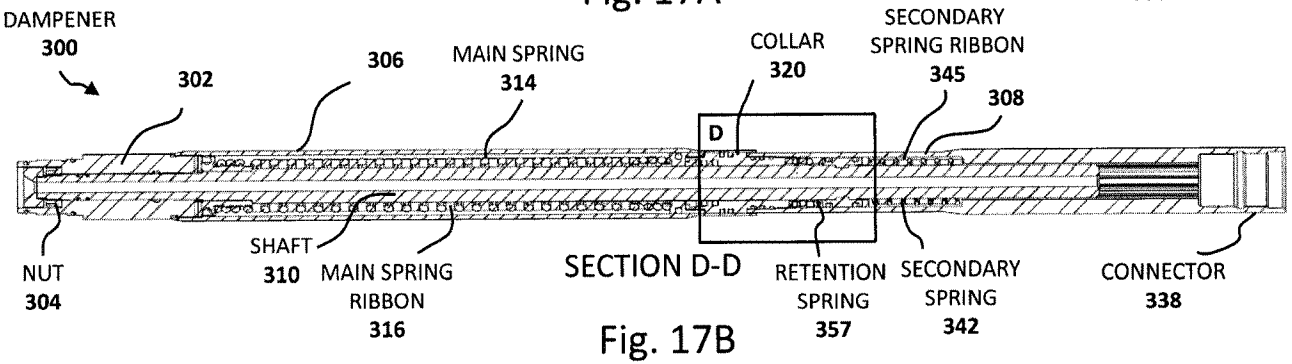
FIG. 17B is a cross sectional view taken long line D-D of FIG. 17A.
Figure 17C:
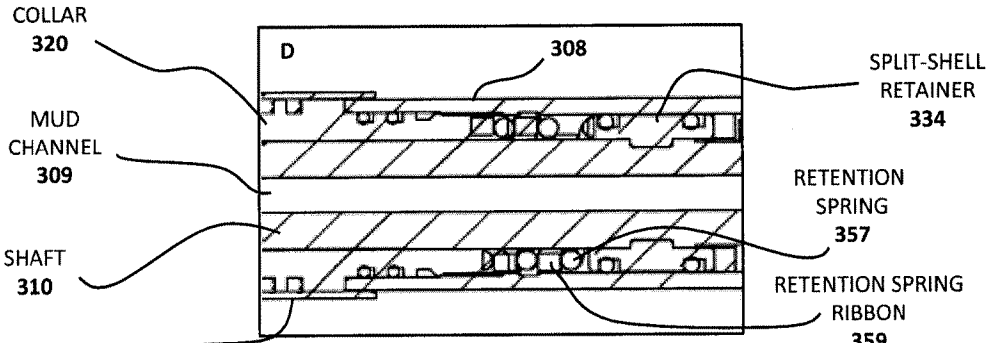
FIG. 17C is a magnified portion D of FIG. 17B.
Figure 18:
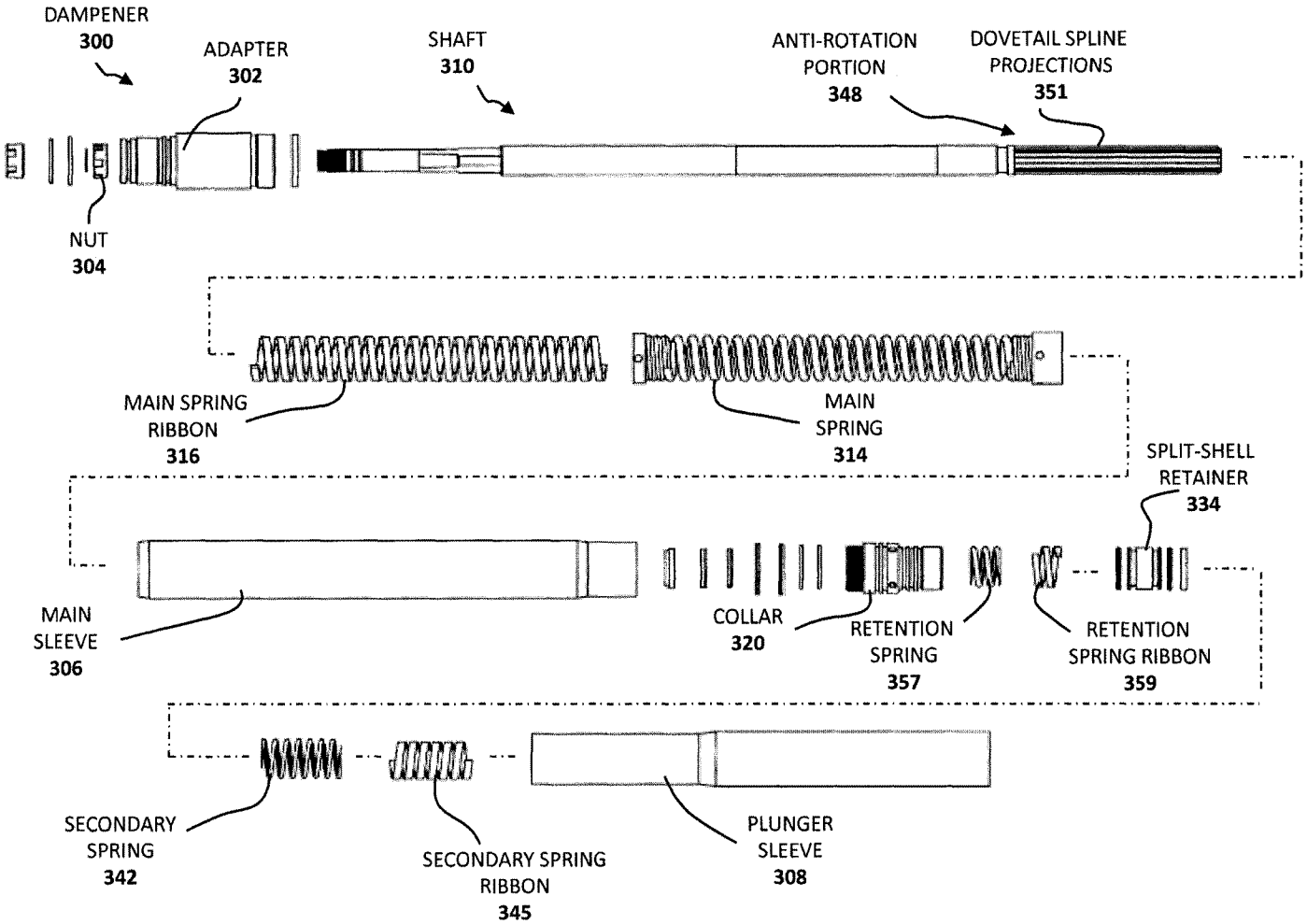
FIG. 18 is an exploded plan view of the same embodiment shown in FIGS. 17A to 17C.

A third embodiment of the dampener device 300 is shown in FIGS. 17 and 18. This third embodiment is generally similar in function to the first embodiment 100 with a few variations described hereinbelow. Wherever possible, similar reference numerals of the 300 series are used to identify components similar to those of the first embodiment 100.

Like the first embodiment 100, the third embodiment has an adapter 302 which connects to a main sleeve 306 configured to hold a main spring 314. This particular embodiment includes an elastomeric main spring ribbon 316 interleaved between the coils of the main spring 314 to provide additional dampening of vibrations, cushion extreme compression on the coils of the main spring 314 and to prevent particulates from entering the spaces between the coils and the outer sidewall of the shaft 310.

Like the first embodiment 100, the third embodiment 300 includes a collar 320 which is seen in cross section in FIGS. 17B and 17C and in the exploded view of FIG. 18. The collar 320 bridges between the main sleeve 306 and the plunger sleeve 308. The plunger sleeve 308 operates in a manner similar to the plunger sleeve 108 of the first embodiment 100 by telescoping into the main sleeve 306 and causing the collar 320 to compress the main spring 314. The right end of the plunger sleeve 308 terminates in a connector 338 which is configured for connection to a downhole main pulser unit (not shown).

As described above for the first embodiment 100, the third embodiment 300, includes a hollow shaft 310 with a mud channel 309 extending therethrough for propagation of mud pulses. In this embodiment 300, the anti-rotation portion 348 on the right side of the shaft in FIG. 18 includes dovetail spline projections 351 which are configured to slide within complementary dovetail grooves (not shown) formed in the inner sidewall of the plunger sleeve 308. The shaft 310 is fixed at the left end to the adapter by a nut 304 which in this embodiment 300, resides inside the adapter 302. As such, in a manner similar to the first embodiment 100, the shaft 310 is fixed with respect to the adapter 302 and the plunger sleeve 308 moves to compress the main spring 314 when moving towards the left in the orientation shown in FIGS. 17 and 18.

This embodiment 300 includes a single secondary spring 342 instead of the three secondary springs 142*a-c* of the first embodiment 100. Additionally, a secondary spring elastomeric ribbon 345 is interleaved between the coils of the secondary spring 342 in a manner similar to the main spring ribbon 316 being interleaved between the coils of the main spring 314.

The last main distinction between the third embodiment 300 and the first embodiment 100 is that a smaller retention spring 357 is provided within the cavity of the plunger sleeve 308 immediately to the right of the collar 320 and to the left of the split-shell retainer 334. The retention spring 357 also has an elastomeric ribbon 359 interleaved between the coils of the retention spring 357. The function of the retention spring 357 and its interleaved ribbon 359 is to provide a counteracting biasing mechanism to prevent the right end of the collar 320 from being exposed if a downhole shock causes the plunger sleeve 308 to be pulled downward. Thus the retention spring 357 and its interleaved ribbon 359 provide enhanced stability and dampening when the dampener 300 is in operation.

It is expected that future testing of this embodiment 300 may reveal that the retention spring 357 provides sufficient dampening to allow the secondary spring 342 and its interleaved ribbon 345 to be omitted from the structure of the dampener 300. This particular alternative embodiment is also within the scope of the invention.

Other than the features described above with respect to the third embodiment 300, this embodiment is generally similar to the first embodiment 100 and functions in a similar manner.

Structural Differences Between the First and Second Dampener Embodiments

The shaft 210 acts as a plunger element in the second embodiment of the dampener 200 whereas in the first embodiment 100 of the dampener, the plunger sleeve 108 is the plunger element. In each case however, a plunger element is responsible for compression and extension of the main spring and the secondary spring. Another difference between the two embodiments is that the uphole end of the shaft 110 is immobilized with respect to the adapter 102 in the first embodiment 100 while the uphole end of the shaft 210 is moveable within the cavity of the adapter 202 in the second embodiment 200. In the first embodiment 100 (and the third embodiment 300), the downhole end of the shaft 110 moves into the cavity of the connector 138, whereas, in the second embodiment 200 the connector 238 is integrally formed with the shaft 210. The third embodiment 300 has features generally similar to those of the first embodiment 100.

There are a number of differences between prior art dampening devices and the two main embodiments described herein which provide significant advantages. The embodiments described herein use drilling mud in the cavities of the dampener as a dampening medium instead of a sealed volume of hydraulic fluid. Spring baffling elements provided by either individual baffles or an interleaved ribbon are provided to further restrict fluid flow to enhance dampening. The main spring acts in both extension and compression modes to dynamically resist external shocks while the secondary spring(s) surrounded by drilling mud act to resist compression. Rotational torque dampening is primarily provided by the elasticity of the rotation-restricted shaft acting as the torsion bar. There is no requirement for a sealed pressure compensation piston and as such, the embodiments described herein are generally simpler in construction with field serviceable and replaceable parts.

Use of the Second Embodiment in an Electromagnetic Telemetry System

Figure 16A:
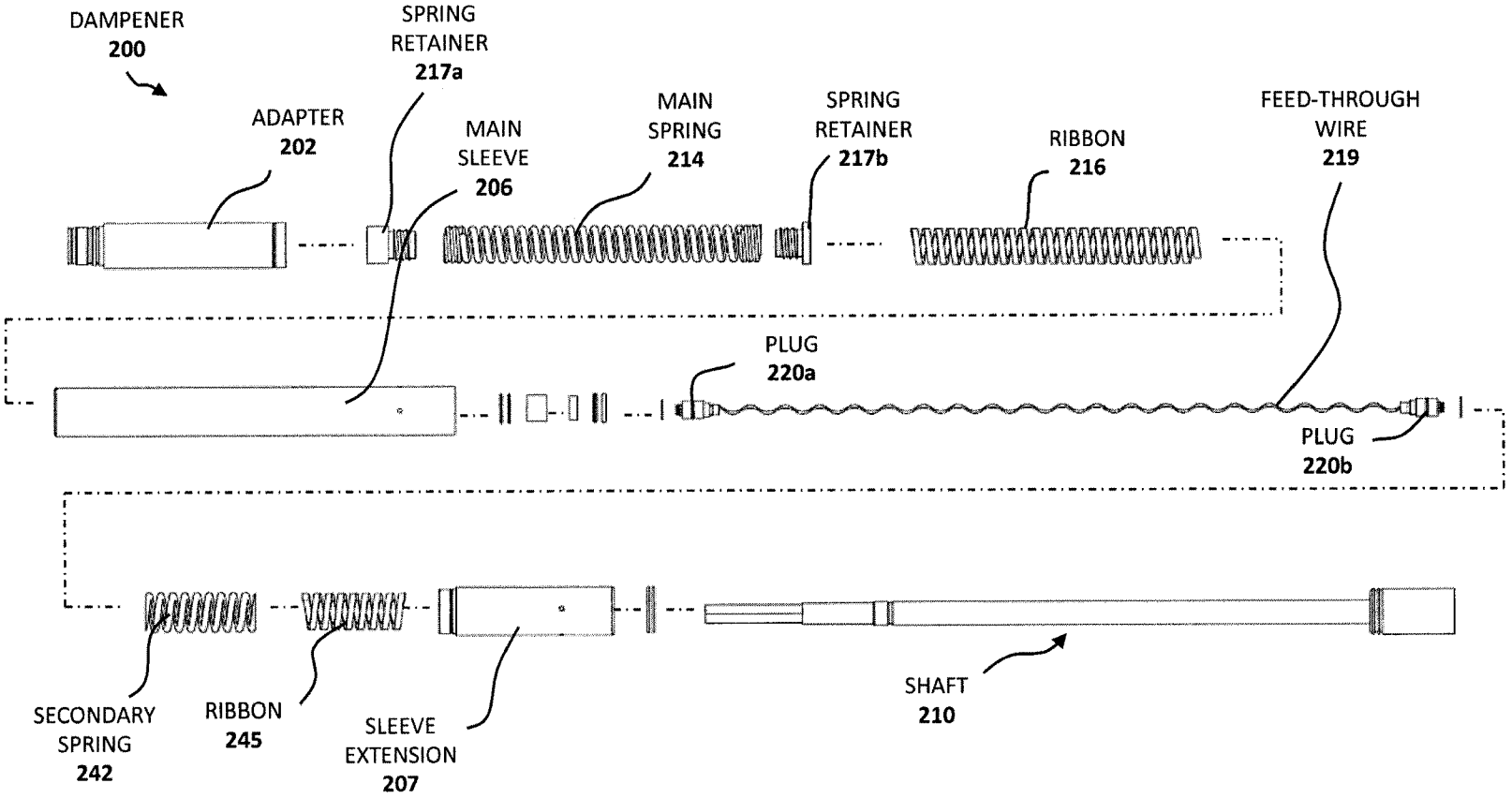
FIG. 16A is an exploded plan view of a variation of the second embodiment 200 of the dampener which includes a coiled feed-through wire 219 for an application of the dampener 200 as part of an electromagnetic telemetry system.
Figure 16B:
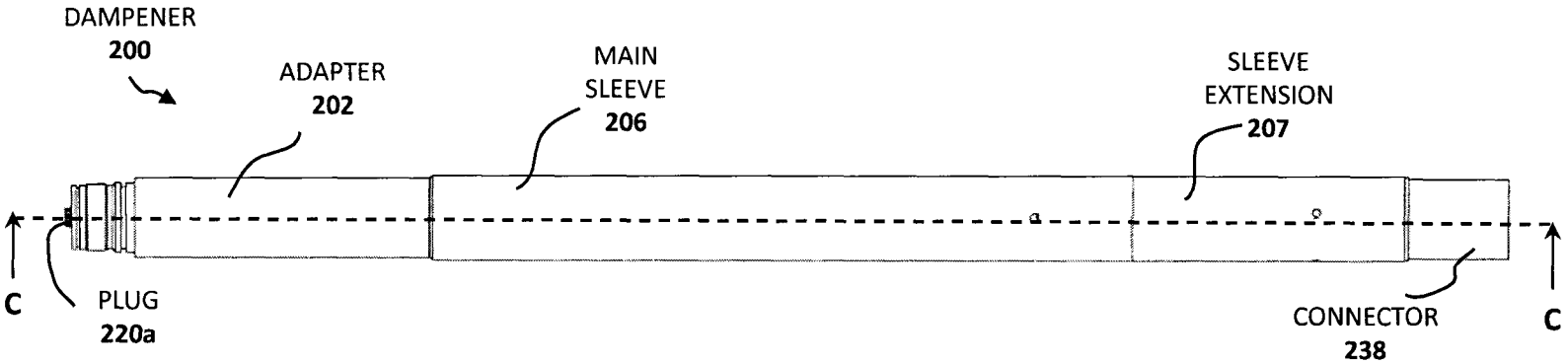
FIG. 16B is a plan view of the same variation of the second embodiment shown in FIG. 16A.
Figure 16C:
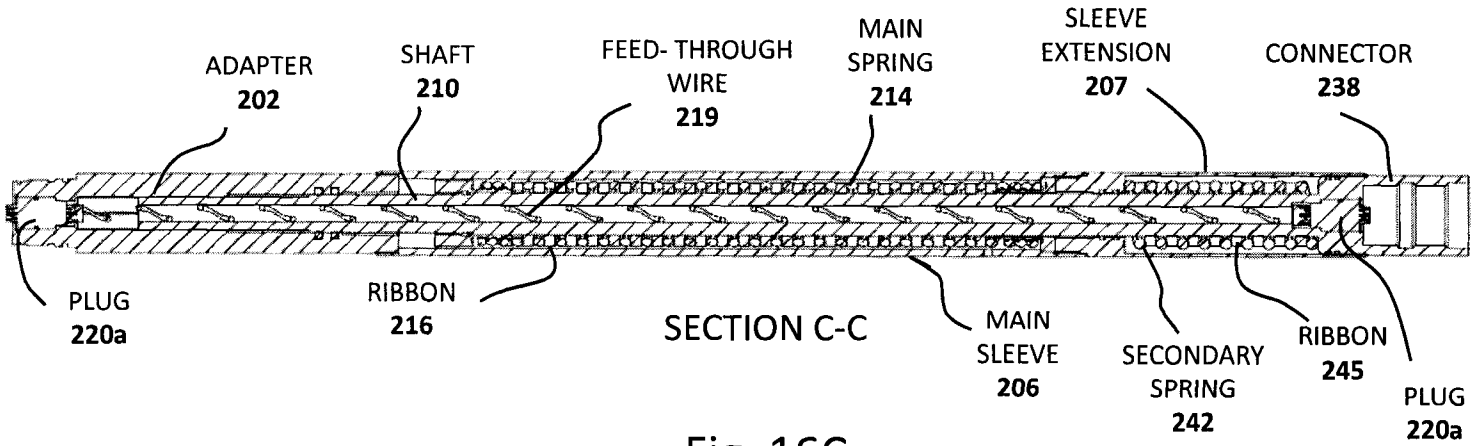
FIG. 16C is a cross sectional view taken along line C-C of FIG. 16B.

As noted briefly above, the second embodiment 200 of the dampener is particularly well suited for incorporation into an electromagnetic telemetry system. In such an arrangement, the orientation of the dampener device is reversed with the connector 238 pointing uphole and the adapter 202 pointing downhole. In this embodiment, there is no drilling fluid flowing through the channel 209 of the shaft 210 because this action is specific to mud pulse telemetry. Instead, as illustrated in FIGS. 16A to 16C, a conducting feed-through wire or fiber optic cable 219 is carried in the channel 209 of the shaft 210. This wire 219 is provided with plugs 220*a* and 220*b* at each end to facilitate connections of the dampener 200 to the other components of the electromagnetic telemetry system according to conventional arrangements.

Alternative Embodiments

While the first embodiment described hereinabove includes three separate wiper seals, it is to be understood that contemplated alternative embodiments of the dampener device will include additional wiper seals or fewer wiper seals while still allowing a sufficient amount of drilling fluid to enter the internal cavities of the dampener device. For example, in one alternative embodiment, the dampener device includes only one wiper seal corresponding to compression wiper seal 152. In another alternative embodiment, the dampener device includes only one wiper seal corresponding to split-shell wiper seal 136. In another alternative embodiment, the dampener device includes only one wiper seal corresponding to collar wiper seal 126. In another alternative embodiment, the dampener device includes two wiper seals corresponding to compression wiper seal 152 and split-shell wiper seal 136. In another alternative embodiment, the dampener device includes two wiper seals corresponding to compression wiper seal 152 and collar wiper seal 126. In another alternative embodiment, the dampener device includes two wiper seals corresponding to split-shell wiper seal 152 and collar wiper seal 126.

In other alternative embodiments, the device is arranged in the opposite orientation in the tool assembly with the connector of the plunger sleeve pointing upward (i.e. acting as the up-hole end of the device and the main sleeve facing downward (i.e. acting as the down-hole end of the device).

In another alternative embodiment, the shaft and the inner sidewall of the plunger sleeve are provided with alternative complementary anti-rotation structures instead of the longitudinal splines of the shaft cooperating with the longitudinal grooves of the inner sidewall of the plunger sleeve. The complementary anti-rotation structure may be any structure that allows the plunger sleeve to move axially past the plunger sleeve while restricting the shaft from rotating within the plunger sleeve. In one example, the shaft includes grooves and the inner sidewall of the plunger sleeve includes splines. In other examples, different-shaped grooves and projections are included in the combination of the shaft and the inner sidewall of the plunger sleeve, such as square projections in the shaft which are complementary to square-shaped grooves in the inner sidewall of the plunger sleeve.

In another alternative embodiment, the dampener device has its coil spring captured at both ends with respect to the main sleeve, by threading attachment to the adapter and with respect to the plunger sleeve by threading attachment to the collar, which is threaded at its opposite end to the plunger sleeve. In this alternative embodiment, the passages for entry of drilling fluid into the cavities of the device is optional because the enhanced compression dampening provided by the captured coil spring is expected to provide sufficient dampening such that additional dampening by internal drilling fluid is not necessary.

Equivalents and Scope

Other than described herein, or unless otherwise expressly specified, all of the numerical ranges, amounts, values and percentages, such as those for amounts of materials, elemental contents, times and temperatures, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. A dampener device configured for incorporation into a downhole tool in a drilling system, the device for absorbing axial, lateral and torsional shocks and vibrations to protect instrumentation during the drilling, the device comprising:

a) a main sleeve having a main cavity containing a main spring;

b) an adapter connected to or formed monolithically relative to the main sleeve, the adapter configured for connection to a first tool component;

c) a plunger configured to compress the main spring;

d) a connector configured for connection to a second tool component, the connector attached to or formed monolithically relative to the plunger;

e) a shaft extending between the adapter and the connector, the shaft provided with an anti-rotation structure; and f) one or more passages leading from the outside of the device into the main cavity, wherein during the drilling the main cavity contains drilling fluid acting as vibration dampening fluid, the drilling fluid having entered the main cavity via the one or more passages during the drilling.

2. The device of claim 1, wherein the shaft and the plunger are the same structure, the connector is formed monolithically relative to the shaft and the main spring is connected to the shaft.

3. The device of claim 1, further comprising a secondary spring in a secondary cavity of the sleeve which is spaced apart from the main cavity.

4. The device of claim 3, further comprising a first elastomeric ribbon interleaved between coils of the main spring and a second elastomeric ribbon interleaved between the coils of the secondary spring.

5. The device of claim 3, wherein the sleeve includes a sleeve extension and the secondary cavity is defined by the interior of the sleeve extension.

6. The device of claim 3, further comprising one or more additional passages leading from the outside of the device into the secondary cavity to act as secondary cavity vibration dampening fluid.

7. The device of claim 1, wherein the second tool component includes a main pulser unit of a measurement-while-drilling tool assembly and the first tool component includes a pulse actuator of the measurement-while drilling tool assembly.

8. The device of claim 1, wherein the shaft includes a channel extending across its entire length, the channel provided to transmit drilling fluid pulses from a pulse actuator to a main pulser unit when used with a mud pulse telemetry system or to provide a path for routing of electrical connections when used with an electromagnetic telemetry system.

9. The device of claim 8, further comprising a cable or wire extending through the channel, the cable or wire configured for connection to components of an electromagnetic telemetry system.

10. The device of claim 1, wherein the main spring is slidable within the main cavity.

11. The device of claim 1, wherein the plunger is a second sleeve having a secondary cavity, the second sleeve configured for telescopic movement into and out of the main cavity of the main sleeve.

12. The device of claim 11, wherein the one or more passages are partially restricted by the presence of wiper seals which allow entry of the drilling fluid into one or both of the main cavity and the secondary cavity while acting as a barrier to exclude entry of particulate matter carried by the drilling fluid.

13. The device of claim 11, wherein the one or more passages is a single passage located in a reduced diameter portion inside the second sleeve to allow the drilling fluid to move from the outer end of the second sleeve to the secondary cavity of the second sleeve.

14. The device of claim 11, wherein the secondary cavity of the second sleeve holds one or more secondary springs around the circumference of the shaft for providing additional compression dampening.

15. The device of claim 14, further comprising a first elastomeric ribbon interleaved between coils of the main spring and a second elastomeric ribbon interleaved between the coils of the one or more secondary springs.

16. The device of claim 11, wherein the second tool component includes a main pulser unit of a measurement-while-drilling tool assembly and the first tool component includes a pulse actuator of the measurement-while drilling tool assembly.

17. The device of claim 11, wherein the shaft includes a channel extending across its entire length, the channel provided to transmit drilling fluid pulses from a pulse actuator to a main pulser unit when used with a mud pulse telemetry system or to provide a path for routing of electrical connections when used with an electromagnetic telemetry system.

18. The device of claim 11, wherein the anti-rotation sleeve-coupling structure of the shaft comprises a series of splines arranged around the circumference of a portion of the shaft.

19. The device of claim 18, wherein the anti-rotation shaft-coupling structure of the second sleeve comprises a series of grooves arranged around the circumference of the inner sidewall of the second sleeve, the grooves dimensioned to retain the splines while allowing the second sleeve to slide over the shaft.

20. The device of claim 11, further comprising a retention spring located between a first blocking structure and a second blocking structure located within the second sleeve.

* * * * *